US008478163B2

(12) United States Patent
Sato et al.

(10) Patent No.: US 8,478,163 B2
(45) Date of Patent: Jul. 2, 2013

(54) IMAGE FORMING DEVICE, TONER CARTRIDGE, DEVELOPER CARTRIDGE, AND IMAGE BEARING MEMBER CARTRIDGE

(75) Inventors: Shougo Sato, Seto (JP); Tsutomu Suzuki, Nagoya (JP); Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1074 days.

(21) Appl. No.: 11/666,604

(22) PCT Filed: Oct. 20, 2005

(86) PCT No.: PCT/JP2005/019313

§ 371 (c)(1),
(2), (4) Date: Feb. 23, 2009

(87) PCT Pub. No.: WO2006/046466

PCT Pub. Date: May 4, 2006

(65) Prior Publication Data

US 2009/0180802 A1 Jul. 16, 2009

(30) Foreign Application Priority Data

Oct. 29, 2004 (JP) ..... 2004-315768

(51) Int. Cl.
*G03G 21/18* (2006.01)

(52) U.S. Cl.
USPC ..... 399/113

(58) Field of Classification Search
USPC ..... 399/111, 113
See application file for complete search history.

(56) References Cited

U.S. PATENT DOCUMENTS

| | | | | |
|---|---|---|---|---|
| 5,369,479 | A | 11/1994 | Tsuyusi | |
| 5,398,098 | A | 3/1995 | Fukunaga et al. | |
| 5,608,501 | A * | 3/1997 | Makino | |
| 6,463,232 | B1 | 10/2002 | Kawai et al. | |
| 2003/0049046 | A1 * | 3/2003 | Okabe | 399/111 |
| 2003/0118368 | A1 * | 6/2003 | Saito et al. | 399/111 |

(Continued)

FOREIGN PATENT DOCUMENTS

| | | | |
|---|---|---|---|
| EP | 1191409 | A | 3/2002 |
| JP | 3-256056 | A | 11/1991 |

(Continued)

OTHER PUBLICATIONS

Chinese Office Action dated May 23, 2008 on Application No. CN200580037387.7.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A photosensitive member cartridge 20, a developing cartridge 40, and a toner cartridge 60 can be mounted in and removed from a common mounting/removing opening 2*a* through a common path without enlarging the device. The mounting/removing opening 2*a* also can be made comparatively small. Thus, a configuration is simplified. The toner cartridge 60 can be mounted or removed by rotating a handle 62 to an upper direction. The developing cartridge 40 and the toner cartridge 60 can be mounted or removed by pressing down a handle 25. The photosensitive member cartridge 20, the developing cartridge 40, and the toner cartridge 60 can be individually exchanged depending on lifetime of the cartridges.

16 Claims, 23 Drawing Sheets

U.S. PATENT DOCUMENTS

| | | | | |
|---|---|---|---|---|
| 2004/0037592 | A1* | 2/2004 | Hiura et al. | |
| 2004/0042817 | A1* | 3/2004 | Mori | 399/113 |
| 2004/0190934 | A1* | 9/2004 | Okabe | 399/111 |

FOREIGN PATENT DOCUMENTS

| | | | | |
|---|---|---|---|---|
| JP | 4-322260 | A | | 11/1992 |
| JP | 5-035002 | A | | 2/1993 |
| JP | 6-035244 | A | | 2/1994 |
| JP | 6-035321 | A | | 2/1994 |
| JP | 6-075440 | A | | 3/1994 |
| JP | 6-110262 | A | | 4/1994 |
| JP | 6-222628 | A | | 8/1994 |
| JP | 7-072779 | A | | 3/1995 |
| JP | 7-181770 | A | | 7/1995 |
| JP | 9-081000 | A | | 3/1997 |
| JP | 11-272054 | A | | 10/1999 |
| JP | 11272054 | A | * | 10/1999 |
| JP | 2000-267547 | | | 9/2000 |
| JP | 2001188457 | A | * | 7/2001 |
| JP | 2002-108170 | A | | 4/2002 |
| JP | 2004-021059 | A | | 1/2004 |

OTHER PUBLICATIONS

Extended European Search Report for European application No. 05795855.5 mailed May 26, 2011.

* cited by examiner

IMAGE FORMING DEVICE, TONER CARTRIDGE, DEVELOPER CARTRIDGE, AND IMAGE BEARING MEMBER CARTRIDGE

TECHNICAL FIELD

The present invention relates to an image forming device of a so-called electrophotographic system which forms an image by developing an electrostatic latent image formed on a photosensitive member with toner and adhering the image on paper. The present invention also relates to a toner cartridge, a developer cartridge, and an image bearing member cartridge which can be used in the image forming device.

BACKGROUND ART

There is known an image forming device including a photosensitive member cartridge, a toner cartridge, and a developing cartridge, in a removable manner. The photosensitive member cartridge contains a photosensitive member. The toner cartridge contains toner. The developing cartridge contains a developing unit which develops an electrostatic latent image formed on the photosensitive member with the toner contained in the toner cartridge. In the image forming device of this kind, when an electrostatic latent image is formed on the photosensitive member, the electrostatic latent image is developed by the developing unit by using the toner contained in the toner cartridge. Then, the toner is adhered to paper, and thereby the image can be formed on the paper.

Here, in a certain kind of image forming device, for example, life of each of the units is different among each other, i.e. life of the photosensitive member is for 50000 sheets, whereas life of the developing unit is for 20000 sheets and life of the toner cartridge is for 3000 sheets. When the photosensitive member cartridge, the developing cartridge, and the toner cartridge are integrated together and exchanged at the same time, cost effectiveness is lowered. Accordingly, each of the cartridges has suggested to be made separable from the other cartridges so that only the cartridge reaching to the end of life is exchanged at a time (for example, refer to Patent Document 1).

Patent Document 1: Japanese Patent Application Publication No. H04-322260

DISCLOSURE OF THE INVENTION

However, in the device disclosed in the Publication, a path of mounting and removing each of the cartridges, that is, a spatial path through which each of the cartridges passes at the time of being mounted and removed, is different from the passes of other cartridges. Therefore, a configuration of the device is complicated in order to mount and remove the cartridges. For example, a cover needs to be opened widely. As described above, the conventional devices cannot achieve the size reduction or simplified structure of the device, with each of the cartridges being separately exchangeable. In view of the foregoing, it is an object of the present invention to provide an image forming device which achieves size reduction with simplified structure while the image forming device includes the photosensitive member cartridge, the developing cartridge, and the toner cartridge can be exchanged separately depending on lifetime thereof.

In addition, in the device disclosed in the Publication, after the photosensitive member cartridge, the developing cartridge, and the toner cartridge are integrated together and taken out at once, a cartridge to be exchanged is separated and exchanged with a new cartridge. For this reason, even in a case where only the toner cartridge is to be exchanged, each of the cartridges needs to be removed from the device once. Therefore, workability of exchanging cartridges is not sufficient. In addition, there is room for improvement for a guide for guiding each of the cartridges being mounted or removed. Therefore, the present invention is invented to provide the toner cartridge, the developing cartridge, or the photosensitive member cartridge which can easily be exchanged by separating the cartridges individually as described above.

Means for Solving the Problem

In order to attain the above and other objects, the invention provides an image forming device includes an image bearing member cartridge, a toner cartridge, and a developer cartridge. The image bearing member cartridge accommodates an image bearing member therein. The toner cartridge accommodates toner therein. The developer cartridge accommodates a developer unit therein that develops an electrostatic latent image formed on the image bearing member by the toner accommodated in the toner cartridge. The image forming device detachably mounts the image bearing member cartridge, the toner cartridge, and the developer cartridge. The image bearing member cartridge, the toner cartridge, and the developer cartridge are mounted to and removed from a body of the image forming device through a common loading port in communication with a common path. At least after the image bearing member cartridge, the toner cartridge, and the developer cartridge are removed from the body of the image forming device, each of the cartridges is separable from other cartridges.

As described above, in the present invention, at least after the image bearing member cartridge, the developer cartridge, and the toner cartridge are removed from the body of the image forming device, each of the cartridges can be separated individually. Therefore, only the cartridge which requires to be exchanged can be exchanged. In addition, each of the cartridges can be mounted to or removed from the common loading port through the common path. Therefore, the device does not become large in size and the loading port can be made small. Thereby, the configuration of the device is simplified. Therefore, in the image forming device of the present invention, a degree of freedom of a place for installation is increased, and a manufacturing cost is reduced.

In the image forming device of the present invention, each of the cartridges may be removed one by one in the order from the one located in the front (a side nearer to the loading port). However, the image bearing member cartridge, the toner cartridge, and the developer cartridge are mounted to and removed from the body of the image forming device while holding the cartridges in an integrally combined state. In this case, when a plurality of the cartridges need to be exchanged, the cartridges can be removed in an integrated manner. Thus, workability for exchanging the cartridges is improved.

Further, when at least one of the image bearing member cartridge, the toner cartridge, and the developer cartridge is left inside the body of the image forming device, at least one of remaining cartridges is capable of being mounted on or removed from the body of the image forming device. In this case, the cartridges can be exchanged while the other cartridges which do not need to be exchanged are left inside the body of the image forming device. Therefore, workability of the exchange of the cartridge is improved.

Furthermore, at least one of the image bearing member cartridge, the toner cartridge, and the developer cartridge includes an operation portion, and the cartridge to be left inside the body of the image forming unit is capable of being selected by operating the operation portion.

Accordingly by operating the operation portion, the cartridges to be left inside the body of the image forming device can be selected. Therefore, workability is further improved when the cartridges are exchanged as described above.

The operation portion includes a handle, and the cartridge to be left inside the body of the image forming unit is capable of being selected by moving the position of the handle. Accordingly, since the handle also works as the operation portion, operation becomes easier, and the configuration is simplified.

Furthermore, the handle is movable between a connecting position for connecting the cartridges and a separating position for separating the cartridges. When the handle is located at the separating position, the handle interferes with a path of a lid portion that covers the loading port of the body of the image forming device, such that the lid portion is not capable of being closed or the handle interferes with a path of a member that moves with the lid portion such that the lid portion is not capable of being closed.

Errors are occur when the image forming device is driven while the cartridges are separated. However, when the above configuration is adopted, the lid portion cannot be closed while the handle is at the separating position. Therefore, wrong operation, such as driving the image forming device while the cartridges are separated, can be prevented.

In addition, in case the operation portion is included as described above, the operation portion is operable when the at least one cartridge with the operation portion is mounted to the body of the image forming unit.

In this case, the cartridges to be left inside the image forming device can be selected while the cartridge having the operation portion is mounted in the body of the image forming device. Therefore, when exchanging only some of the cartridges, workability is further improved.

In addition, the image bearing member cartridge, the toner cartridge, and the developer cartridge are located in an order of lifetime from the loading port to inside the image forming device. And the toner cartridge, the developer cartridge, and the image bearing member cartridge are located in this order from the loading port to inside the image forming device, when the toner cartridge, the developer cartridge, and the image bearing member cartridge are mounted in the image forming device. A following effect is achieved. That is, the cartridges are arranged in the order of a higher frequency of exchange from a front side. Therefore, workability of the exchange is further improved.

In addition, the image bearing member cartridge, the toner cartridge, and the developer cartridge are located in an order of lifetime from the loading port to inside the image forming device. And, the image bearing member cartridge, the toner cartridge, and the developer cartridge are located in an order of lifetime from the loading port to inside the image forming device.

Accordingly, the cartridges are arranged in the order of a higher frequency of exchange from a front side. Therefore, workability for exchanging the cartridge is further improved.

Further, in any of the image forming devices described above, each path on which the image bearing member cartridge, the toner cartridge, and the developer cartridge are mounted to or removed from the body of the image forming device is linearly configured. Since the paths are linear, exchange of the cartridges is further facilitated.

In addition, in any of the image forming devices described above, the loading port is disposed on a front side of the body of the image forming device (that is, a surface which is arranged in the front). Accordingly, the cartridges can be exchanged from the front side. Therefore, workability of the exchange is improved.

In addition, in any of the image forming devices described above, the body of the image forming device detachably mounts a feeding cassette that accommodates recording sheets to which the toner developing the electrostatic latent image formed on the image bearing member is adhered. The loading port is disposed on a side from which the feeding cassette is mounted to and removed from the body of the image forming device.

Accordingly, the mounting and removing of the feeding cassette for feeding the recording sheet and the exchange of the cartridges can be carried out on the same side. Therefore, workability of the exchange is improved.

In addition, in any of the image forming devices, any one of the image bearing member cartridge, the toner cartridge, and the developer cartridge that is disposed in a downstream side with respect to a mounting direction is formed with a guide that guides another cartridge that is disposed an upstream side.

Accordingly, the guide guides the cartridge on an upper stream side than the cartridge in which the guide is provided. Therefore, the mounting and removing of the cartridges is further facilitated.

Furthermore, in any of the image forming devices, at least one of the image bearing member cartridge, the toner cartridge, and the developer cartridge includes a drum or a roller. The image bearing member cartridge, the toner cartridge, and the developer cartridge are mounted to or removed from the image forming device in a direction orthogonal to a rotational axis of the drum or the roller.

Accordingly, the cartridge including the drum or the roller can be mounted or removed with both ends of the rotational axis being guided portions. In this manner, the mounting and removing of the cartridges is further facilitated while the configuration of the device is further simplified.

According to another aspects, the invention provides toner cartridge. The toner cartridge accommodates toner and is detachably mounted to a developer cartridge that includes a developer unit which develops an electrostatic latent image formed on an image bearing member by the toner. The toner cartridge includes an operation portion that switches a connection/separation between the toner cartridge and the developer cartridge. The operation portion is operable when the developer cartridge is mounted to a body of an image forming unit.

In the toner cartridge of the present invention configured as above, the connection and the separation between the toner cartridge and the developer cartridge can be switched by operating the operation portion. Further, the operation portion can be operated while the developer cartridge is mounted in the body of the image forming device. Thus, in the present invention, only the toner cartridge can easily be exchanged by separating the toner cartridge from the developer cartridge by operating the operation portion.

In the present invention, a construction of the operation portion is not specially limited. However, the operation portion includes a handle for mounting to or removing from the toner cartridge. The connection/separation of the developer cartridge is switched by moving a position of the handle.

Accordingly, the handle also works as the operation portion. Therefore, operation is further facilitated and the configuration is simplified.

The handle is movable between a connecting position for connecting the cartridges and a separating position for separating the cartridges. When the handle is located at the separating position, the handle interferes with a path of a lid portion which covers a loading port which is formed in a body of the image forming unit and through which the toner cartridge is mounted and removed, such that the lid portion is not capable of being closed or the handle interferes with a path of a member that moves with the lid portion such that the lid portion is not capable of being closed.

Errors, such as partial fixing of toner, occurs when the image forming device is driven while the toner cartridge is left separated from the developer cartridge. However, when the above configuration is adopted, the lid portion cannot be closed while the handle is at the separating position. Therefore, wrong operation such as driving the image forming device while the toner cartridge is separated from the developer cartridge can be prevented.

In addition, as to the toner cartridge of the present invention, the operation portion switches a connection or separation between the toner cartridge and the developer cartridge, and is operable after the developer cartridge and the toner cartridge are removed from the body of the image forming device. By this construction, a plurality of the cartridges can be removed in an integrated manner when the cartridges need to be exchanged. Therefore, workability of exchange is improved.

The developer cartridge includes a roller, and the toner cartridge is mounted or removed in a direction orthogonal to a rotational axis of the roller. Alternatively, the developer cartridge includes a roller, and the toner cartridge is mounted to or removed from the developer cartridge in a direction parallel to a rotational axis of the roller.

In these manners, a variety of modifications can be made in the configuration of the toner cartridge and the developer cartridge.

According to still another aspects, the invention provides a toner cartridge. The toner cartridge is used in an image forming device. The image forming device is detachably formed with an image bearing member cartridge, the toner cartridge, and a developer cartridge. The image bearing member cartridge includes an image bearing member. The toner cartridge accommodating toner. The developer cartridge includes a developer unit that develops an electrostatic latent image on the image bearing member by the toner accommodated in the toner cartridge. The toner cartridge includes an agitator and a shaft member. The agitator agitates the toner. The shaft member is either a rotational shaft of the agitator or a shaft extending in parallel to the rotational shaft of the agitator. The shaft member is guided by the guide being formed in the developer cartridge.

In this case, the toner cartridge can be mounted or removed by being guided by the guide formed on the developer cartridge with the shaft member which is either a rotational shaft of the agitator or the shaft extending in parallel to the rotational shaft of the agitator as a guided portion. Therefore, by the toner cartridge of the present invention, the mounting and removing can be facilitated without complicating the configuration of the toner cartridge.

According to still another aspects, the invention provides a developer cartridge. The developer cartridge is used in an image forming device. The image forming device is detachably formed with at least an image bearing member cartridge, a toner cartridge, and the developer cartridge. The image bearing member cartridge includes an image bearing member. The toner cartridge accommodates toner. The developer cartridge includes a developer unit that develops an electrostatic latent image formed on the image bearing member by the toner accommodated in the toner cartridge. The developer cartridge includes a guide and a shaft member. The guide guides the toner cartridge. The shaft member is either a rotational shaft of the agitator or a shaft extending in parallel to the rotational shaft of the agitator. The shaft member is guided by the a guide formed in the image bearing cartridge.

On the developer cartridge of the present invention configured as above, the guide for guiding the toner cartridge is formed. Therefore, the mounting and removing of the toner cartridge with respect to the developer cartridge is facilitated. In addition, in the present invention, the developer cartridge can be mounted or removed by being guided by the guide formed on the image bearing member cartridge with the shaft member which is either the rotational shaft of the agitator or the shaft extending in parallel to the rotational shaft of the agitator as a guided portion. Therefore, by the developer cartridge of the present invention, the mounting and removing of the developer cartridge can be facilitated without complicating the configuration.

According to still another aspects, the invention provides an image bearing member cartridge.

The image bearing member cartridge is used in an image forming device. The image forming device is detachably formed with at least the image bearing member cartridge, a toner cartridge, and a developer cartridge. The image bearing member cartridge includes an image bearing member. The toner cartridge accommodates toner. The developer cartridge includes a developer unit that develops an electrostatic latent image formed on the image bearing member by the toner accommodated in the toner cartridge. The image bearing member includes a guide that guides the toner cartridge. The guide is formed parallel to a direction in which the developer cartridge is mounted to or removed from the image bearing member cartridge.

On the image bearing member cartridge of the present invention configured as above, the guide for guiding the developer cartridge is formed. Thus, the mounting and removing of the developer cartridge with respect to the image bearing member cartridge is facilitated. In addition, in the present invention, the guide is formed parallel to a direction in which the developer cartridge is mounted to or removed from the image bearing member cartridge. For this reason, the guide never interferes with the mounting and removing of the toner cartridge in and from the developer cartridge. In addition, the mounting and removing of the toner cartridge in and from the developer cartridge, described above, and the mounting and removing of the developer cartridge in and from the image bearing member cartridge of the present invention can be carried out from the same direction. Therefore, in the present invention, both the mounting and removing of the toner cartridge in and from the developer cartridge and the mounting and removing of the developer cartridge in and from the image bearing member cartridge (present invention) can easily be carried out.

Advantage of the Invention

According to the image forming device, the toner cartridge, the developer cartridge, and the image bearing member cartridge of the present invention, the toner cartridge, the developer cartridge, or the image bearing member cartridge can be appropriately separated and exchanged without the device becoming larger in size and with a simple configuration.

EXPLANATION OF REFERENCE NUMERALS

Figure 1:
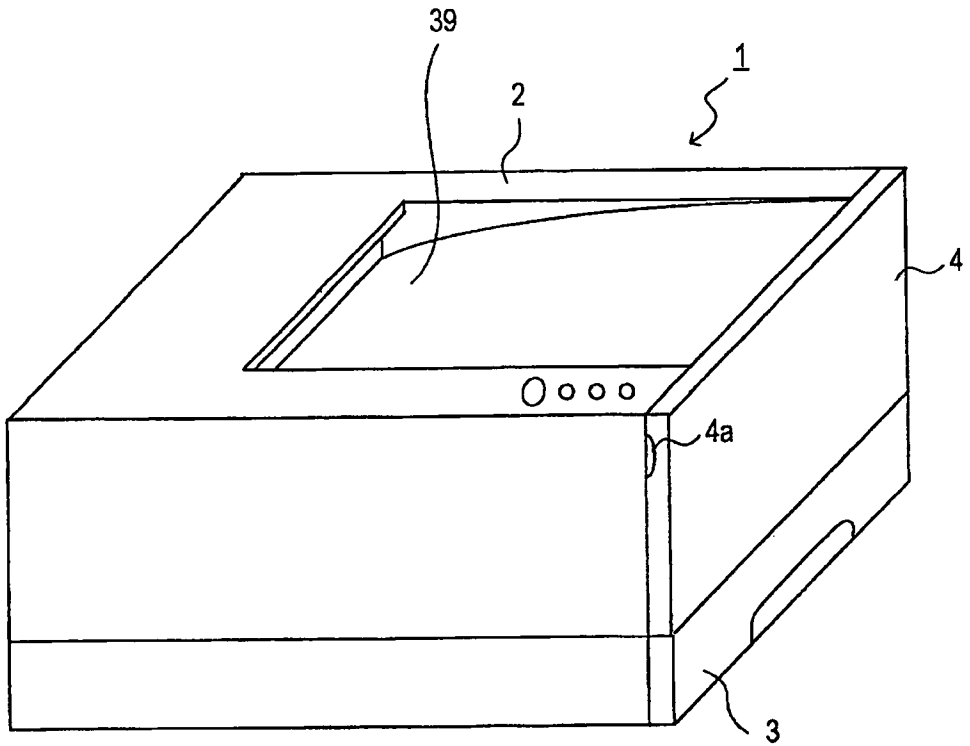
FIG. 1 is a perspective view showing an external view of a laser printer to which the present invention is applied.

1, 101, 201: laser printer
2*a*: mounting/removing opening
3: paper feeing cassette
4: lid portion
20, 120, 220: photosensitive member cartridge
21: photosensitive drum
25, 62, 162, 262: handle
26, 126, 226: plate spring
26*a*: bending section
40, 140, 240: developing cartridge
41: developing roller
42, 142, 242: supporting portion
42*d*: guide groove
42*e*: lower side edge
60, 160, 260: toner cartridge
63: inner cylinder
64: outer cylinder
72: interfering member
90: scanner unit
126*a*, 226*a*: protrusion
142*e*, 242*e*: through-hole
L: laser light

BEST MODE FOR CARRYING OUT THE INVENTION

Next, an embodiment of the present invention will be described with reference to the accompanying drawings. FIG. 1 is a perspective view showing an external view of a laser printer 1 as an image forming device to which the present invention is applied. As shown in FIG. 1, a cover 2 covers a body of the laser printer 1 from an outer periphery. A paper feeding cassette 3 is mounted to a lower part of the cover 2. A lid portion 4 of the cover 2 is provided on a front surface of the cover 2 (that is, a surface which is arranged in the front when the laser printer 1 is installed).

Figure 2:
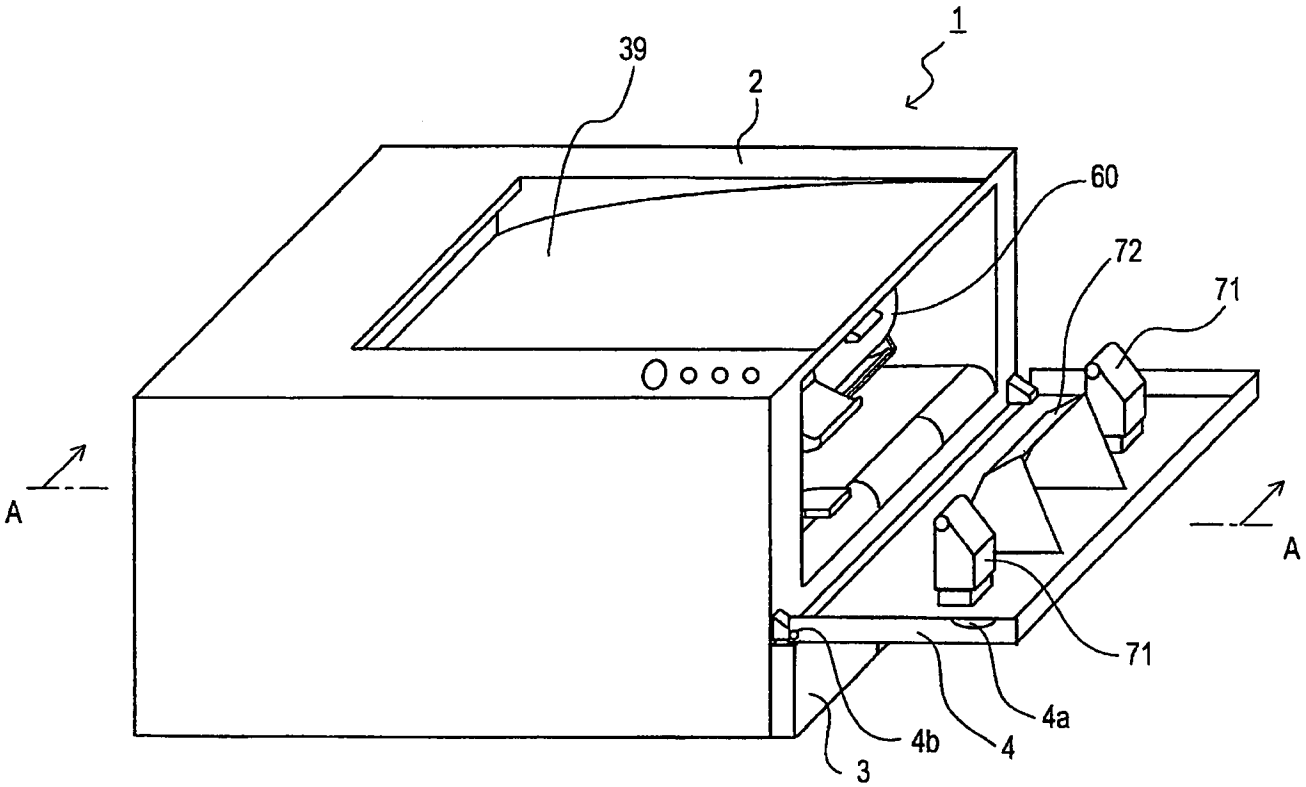
FIG. 2 is a perspective view showing operation of opening a lid portion of the laser printer.
Figure 3:
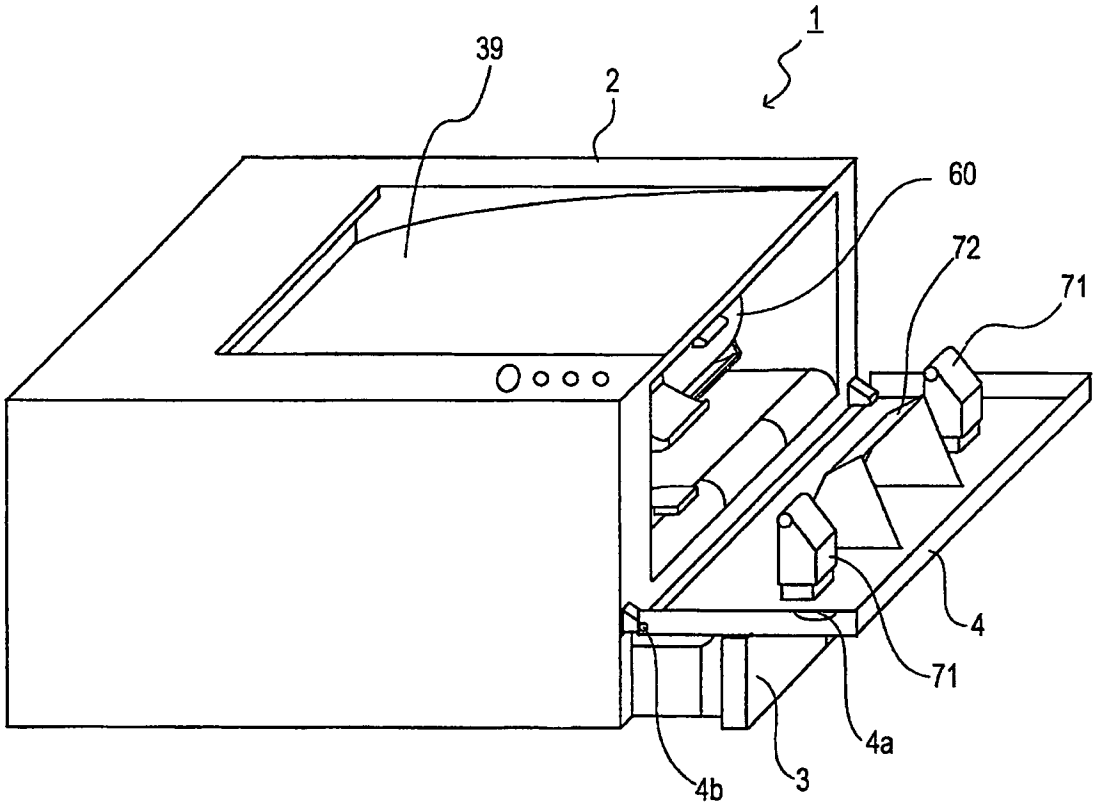
FIG. 3 is a perspective view showing operation of pulling out a paper feeding cassette of the laser printer.

As shown in FIG. 2, the lid portion 4 includes a finger hook part 4*a* on an upper side of both left and right edges. The lid portion 4 can be open in a front direction around a hinge 4*b* on a bottom edge by pulling the finger hook part 4*a*. Further, as shown in FIG. 3, the paper feeding cassette 3 is capable of pulling out in a front direction. By being pulled out in this way, the paper feeding cassette 3 can removed from the laser printer 1.

Figure 4:
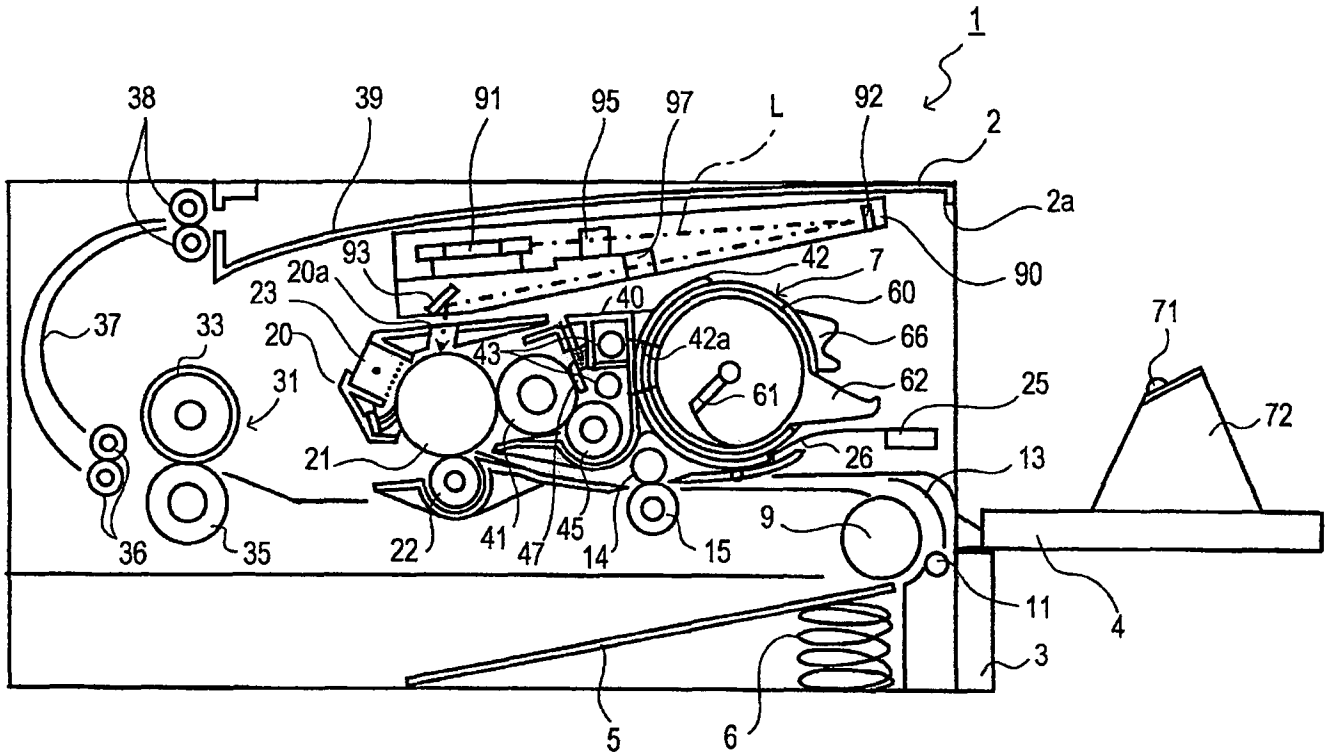
FIG. 4 is a vertical cross sectional diagram showing an inside configuration of the laser printer.

Next, FIG. 4 is a vertical cross sectional diagram showing an internal configuration of the laser printer 1. FIG. 4 is a cross section cut along the A-A line in FIG. 2. As shown in FIG. 4, a supporting plate 5 is provided in the paper feeding cassette 3. The supporting plate 5 is urged upward by a spring 6. A paper feeding roller 9 is provided on a front and upper side of the supporting plate 5. The paper feeding roller 9 separates sheets of paper (not shown) retained on the supporting plate 5 in a laminated manner sheet by sheet, and supplies the separated sheet of paper in a direction of an image forming unit 7. The laser printer 1 includes the paper feeding roller 9, a conveying roller 11, a guide 13, and a pair of registration rollers 14 and 15, in this order, in a conveying path of the paper to a image forming unit 7. The conveying roller 11 conveys the paper in cooperation with the paper feeding roller 9. The guide 13 turns the paper conveyed by the conveying roller 11 for about 180° along an outer periphery of the paper feeding roller 9. The pair of the registration rollers 14 and 15 lock a front edge of the paper by stopping as appropriate to correct oblique conveyance of the paper.

The image forming unit 7 includes a photosensitive drum 21 and a transfer roller 22. The photosensitive drum 21 works as a photosensitive member provided in a photosensitive member cartridge 20. The transfer roller 22 faces the photosensitive drum 21. The paper passes between the photosensitive drum 21 and the transfer roller 22 to have an image formed thereon by toner as will be described later, and is supplied to a fixing unit 31. In the fixing unit 31, the toner image formed on the paper is heat fixed by being sandwiched by a heating roller 33 and a pressing roller 35. The paper on which the image is fixed is further conveyed by a pair of conveying rollers 36 and 36.

The paper conveyed by the conveying rollers 36 and 36 is led to an upper direction of the cover 2 by a guide 37. The paper is then discharged to a paper discharge tray 39 provided on an upper surface of the cover 2 by a pair of paper discharge rollers 38 and 38. In addition, a scanner unit 90 is disposed between the paper discharge tray 39 and the photosensitive member cartridge 20. The scanner unit 90 exposes the photosensitive drum 21 with laser light L.

Configurations of the image forming unit 7 and the scanner unit 90 will be described more in detail. The photosensitive member cartridge 20 includes the photosensitive drum 21 having a photosensitive layer on a front surface in a rotatable manner. Further, the photosensitive member cartridge 20 includes a Scorotron charger 23 which uniformly charges front surfaces of the transfer roller 22 and the photosensitive drum 21. On the front surface of the photosensitive drum 21 charged by the Scorotron charger 23, an electrostatic latent image is formed by the laser light L which enters from the scanner unit 90 through an exposure opening 20*a*. Subsequently, a developing roller 41 supplies the toner to the front surface of the photosensitive drum 21 to develop the electrostatic latent image. The developing roller 41 works as a developing unit provided in a developing cartridge 40 which will be described in the next paragraph. The toner adhered to the photosensitive drum 21 in the manner described above is transferred to the paper passing between the photosensitive drum 21 and the transfer roller 22. Accordingly, the image is formed on the paper.

As shown in FIG. 4, the developing roller 41 is rotatably supported by the developing cartridge 40. The developing roller 41 contacts the photosensitive drum 21 and is rotatably driven by a mechanism which will be described later. The developing cartridge 40 includes a supporting unit 42 which supports a toner cartridge 60 in a removable manner. An opening 42*a* is pierced through the supporting unit 42 (see FIG. 7). The toner is supplied through the opening 42*a* from the toner cartridge 60. Further, the developing cartridge 40 includes a pair of augers 43 and 43, a supplying roller 45, and a developing blade 47. The pair of the augers 43 and 43 conveys the toner from the opening 42*a* disposed on a center in an axial direction of the supplying roller 45 to both sides of the supplying roller 45 in the axial direction. The supplying roller 45 supplies the toner conveyed by the augers 43 and 43 toward the developing roller 41. The developing blade 47 frictionally charges the toner adhered to a front surface of the developing roller 41 by the supplying roller 45 and forms a thin layer of the toner. An agitator 61 is provided inside the toner cartridge 60 in a rotatable manner. The agitator 61 agitates the toner contained in the toner cartridge 60 and supplies the toner to a side of the developing cartridge 40.

Subsequently, a configuration of the scanner unit 90 will be described. The scanner unit 90 includes a polygon mirror 91 and mirrors 92 and 93. The polygon mirror 91 deflects and scans the laser light L generated by a laser generating unit (not shown). Mirrors 92 and 93 reflect the laser light L deflected by the polygon mirror 91 toward the photosensitive drum 21. In addition, an fθ lens 95 is fixed in a light path of the laser light L from the polygon mirror 91 to the mirror 92, and a cylindrical lens 97 is fixed in a light path of the laser light L from the mirror 92 to the mirror 93.

In the above configuration, the polygon mirror 91 and the photosensitive drum 21 are rotated to exit the laser light L in an appropriate timing. Thereby, an electrostatic latent image can be formed on a front surface of the photosensitive drum 21. Then, as described above, the electrostatic latent image is transferred to the paper after being developed with the toner through the developing roller 41. Thereby, images can be formed by electrophotography processes.

Figure 5:
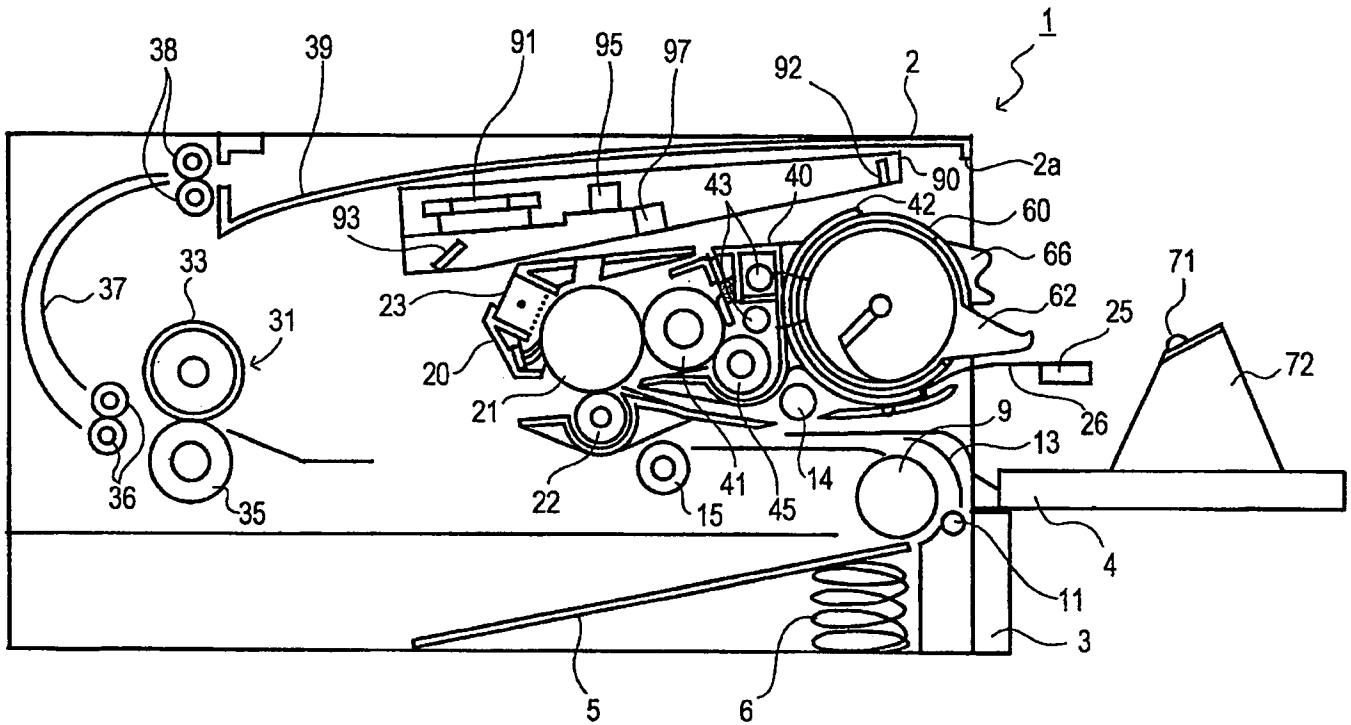
FIG. 5 is a vertical cross sectional diagram showing an operation of removing the cartridges of the printer in an integrated manner.

Next, as shown in FIG. 5, the lid portion 4 is opened, and further, a handle 25 of the photosensitive member cartridge 20 is pulled in a front direction. In this manner, the photosensitive member cartridge 20 can be taken out with the developing cartridge 40 and the toner cartridge 60 in an integrated manner from a mounting/removing opening 2*a* to outside a device body of the laser printer 1. The mounting/removing opening 2*a* is an opening of the cover 2 closed by the lid portion 4.

Figure 6:
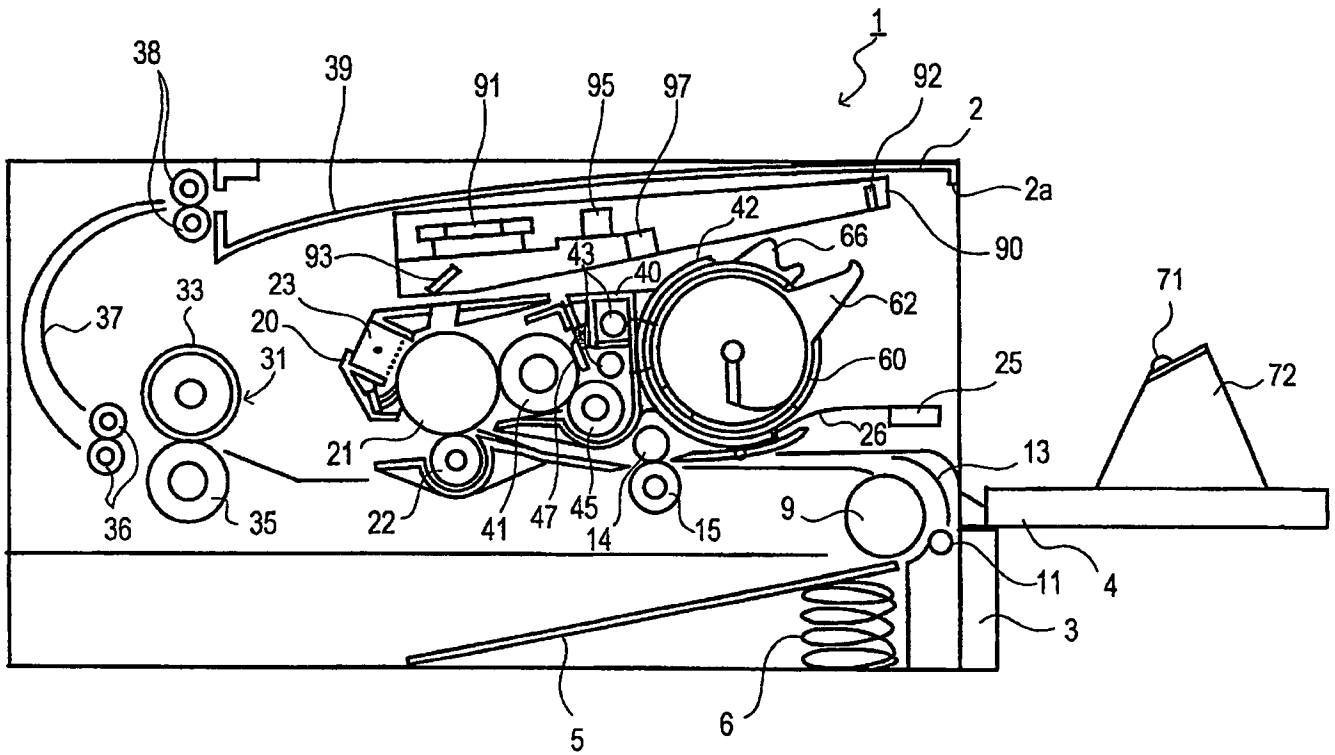
FIG. 6 is a vertical cross sectional diagram showing an operation of separating a toner cartridge and a developing cartridge of the laser printer.
Figure 7:
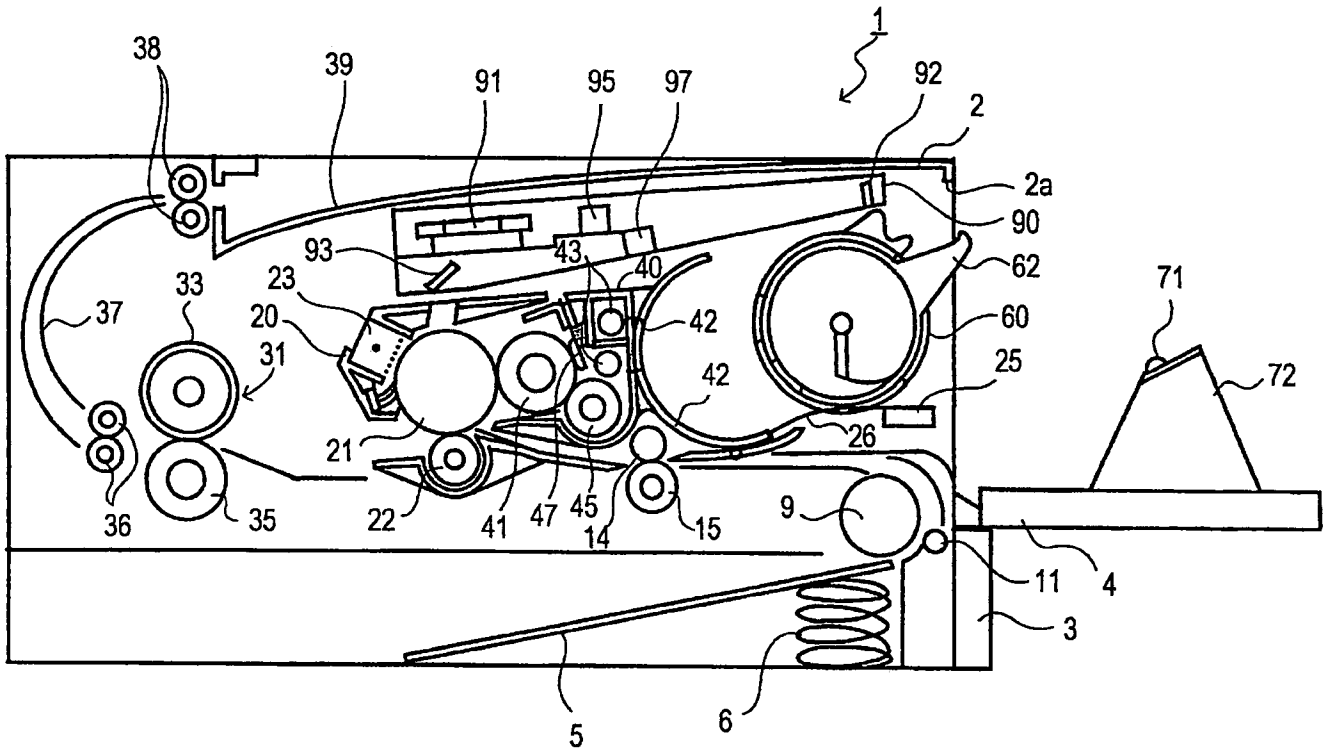
FIG. 7 is a vertical cross sectional diagram showing an operation of removing only the toner cartridge of the laser printer.

In addition, as shown in FIG. 6, when a handle 62 of the toner cartridge 60 is rotated to an upward direction, the toner cartridge 60 is separated from the developing cartridge 40 as described later. Subsequently, as shown in FIG. 7, when the handle 62 is pulled in a front direction, only the toner cartridge 60 can be removed from the mounting/removing opening 2*a* to outside the device body of the laser printer 1. That is, the mounting/removing opening 2*a* corresponds to a toner cartridge mounting/removing opening.

Figure 8:
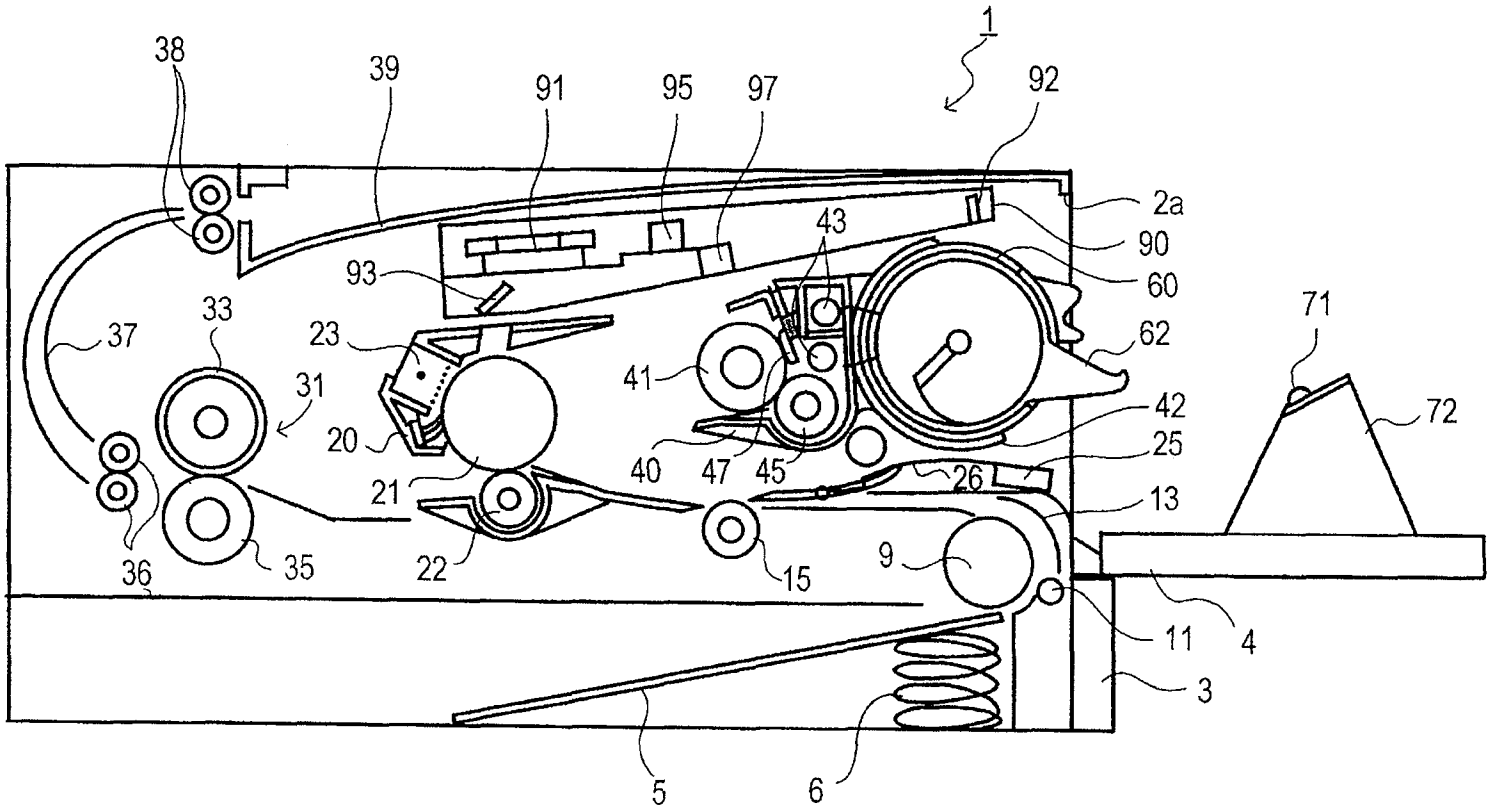
FIG. 8 is a vertical cross sectional diagram showing an operation of removing the developing cartridge and the toner cartridge of the laser printer in an integrated manner.

Moreover, as shown in FIG. 8, when the handle 25 of the photosensitive member cartridge 20 is pressed down, the developing cartridge 40 is separated from the photosensitive member cartridge 20 as described later. Further, when the handle 62 of the toner cartridge 60 is pulled in a front direction without rotating to the upward direction, the toner cartridge 60 and the developing cartridge 40 can be removed from the mounting/removing opening 2*a* to outside the device body of the laser printer 1.

A configuration of switching over a connection and a separation between each of the cartridges 20, 40, and 60 will be described. First, a configuration of switching over a connection and a separation between the developing cartridge 40 and the toner cartridge 60 will be described.

Figure 9A:
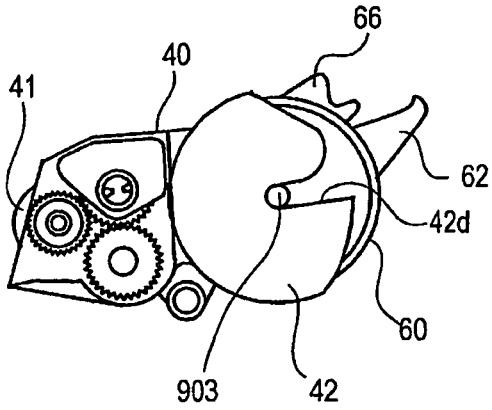
FIG. 9A is an explanatory diagram showing a separated state explaining a mechanism of switching over a connection and a separation between the developing cartridge and the toner cartridge.
Figure 9B:
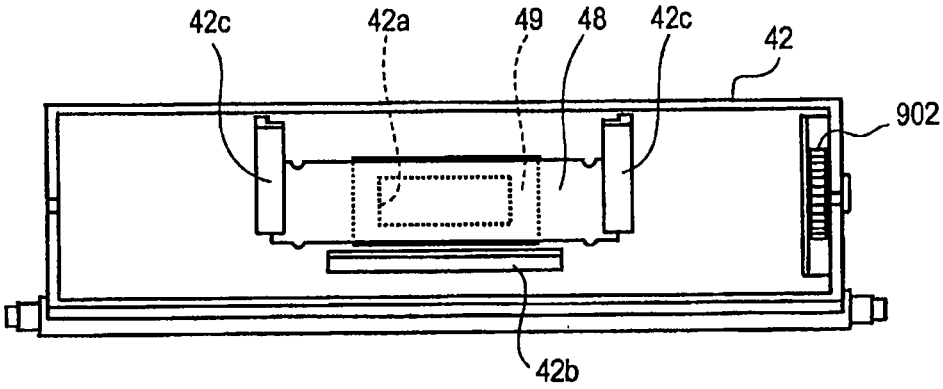
FIG. 9B is a view of a supporting member of the developing cartridge from a side of the toner cartridge.
Figure 9C:
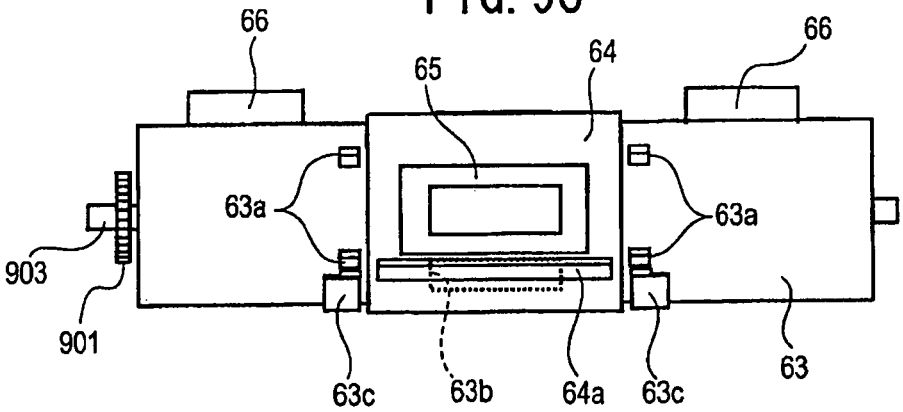
FIG. 9C is a view showing the toner cartridge from a side of the supporting member.

FIG. 9B and FIG. 9C show a state in which the handle 62 of the toner cartridge 60 is rotated to an upward direction (hereinafter, referred to as the separating position) as shown in FIG. 9A. FIG. 9B is a view of the supporting unit 42 of the developing cartridge 40 when viewed from a side of the toner cartridge 60. FIG. 9C is a view of the toner cartridge 60 viewed from a side of the supporting unit 42.

As shown in FIG. 9C, the toner cartridge 60 includes an inner cylinder 63 and an outer cylinder 64. The inner cylinder 63 has an elongated cylindrical shape and contains the toner inside. The outer cylinder 64 is fitted over a central part of the inner cylinder 63. A convex 64*a* protrudes to a side of the supporting unit 42 when the outer cylinder 64 is mounted in the supporting unit 42. The outer cylinder 64 is mounted in the supporting unit 42 by engaging a convex 64*a* with a long groove 42*b* on an inner wall surface of the supporting unit 42. Thus, the outer cylinder 64 is prevented from rotating to the supporting unit 42 by the engagement between the supporting unit 42 and the convex 64*a*. The inner cylinder 63 is integrally formed with the handle 62 and rotatably disposed on a inner side of the outer cylinder 64 corresponding to operation of the handle 62.

In addition, as shown in FIG. 9B, a shutter 48 made of a metal plate is provided inside the supporting unit 42. Both edges of the shutter 48 are supported by a rail 42*c* formed on an inner wall surface of the supporting unit 42. Thereby, the shutter 48 is arranged between a position at which the shutter 48 blocks the opening 42*a* of the supporting unit 42 as shown in FIG. 9B and a position above the opening 42*a* (see FIG. 10B), in a movable manner in a direction of the inner periphery of the supporting unit 42.

Four protrusions 63*a* are formed on a front surface of the inner cylinder 63. Four protrusions 63*a* serve to hold the shutter 48 of four corners thereof, two corners being circumferentially disposed from the remaining two corners. For this reason, the shutter 48 moves corresponding to a rotation of the inner cylinder 63. When the handle 62 is located at the separating position, the shutter 48 is located at the position at which the shutter 48 blocks the opening 42*a* as shown in FIGS. 9B and 9C. The long groove 42*b* described above is formed in a lower position than the shutter 48 so that the long groove 42*b* does not overlap the shutter 48 that is located in the position at which the shutter 48 blocks the opening 42*a*. In addition, the opening 42*a* is configured to have a rectangular shape with a longer side being in a horizontal direction. A sponge 49 having a rectangular frame shape surrounding the opening 42*a* is affixed on an inner wall surface of the supporting unit 42 around the opening 42*a*.

An opening 64*b* having the same shape as the opening 42*a* is formed in a position facing the opening 42*a* when the convex 64*a* is engaged with the long groove 42*b*. A sponge 65 having the same shape as the sponge 49 is affixed around the opening 64*b*. In addition, an opening 63*b* having the same shape as the opening 64*b* is formed in the inner cylinder 63 as well. The opening 64*b* and the opening 63*b* do not overlap each other at all when the handle 62 is located at the separating position as shown in FIG. 9C. For this reason, even when the toner cartridge 60 is taken out, the inside toner does not spill over.

Figure 10A:
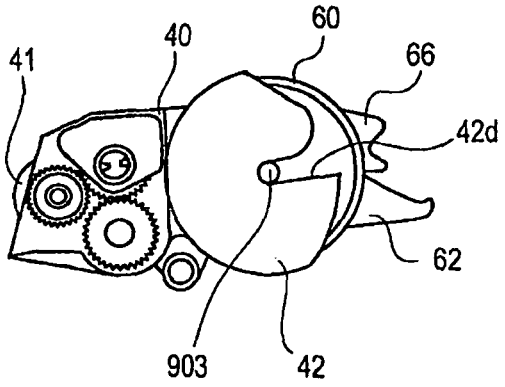
FIG. 10A is an explanatory diagram showing a connected state explaining a mechanism of switching over a connection and a separation between the developing cartridge and the toner cartridge.
Figure 10B:
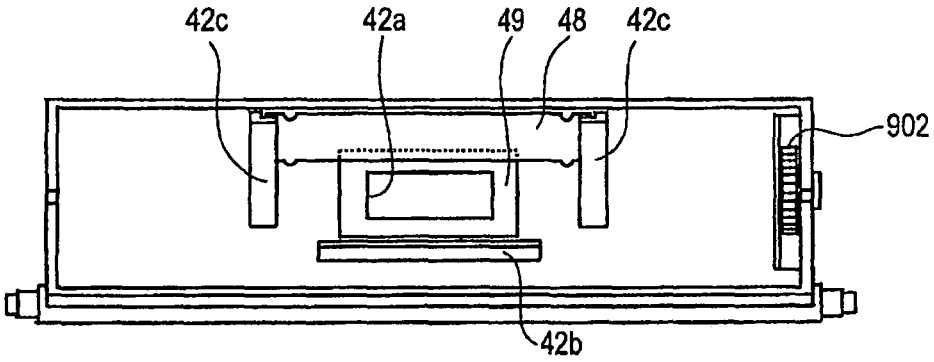
FIG. 10B is a view of a supporting member of the developing cartridge from a side of the toner cartridge.
Figure 10C:
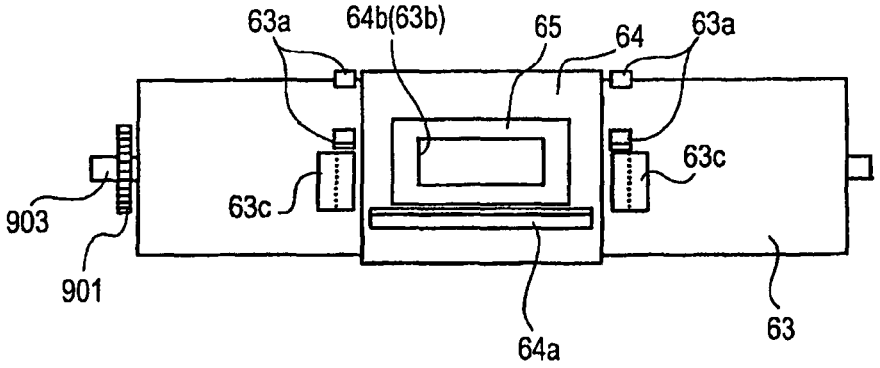
FIG. 10C is a view showing the toner cartridge from a side of the supporting member.

Then, when the handle 62 of the toner cartridge 60 is rotated to a downward direction as shown in FIG. 10A (hereinafter, the handle 62 located at this position is referred to as a connecting position) with the convex 64*a* engaged with the long groove 42*b*, the opening 64*b* and the opening 63*b* overlap each other as shown in FIG. 10C. In addition, at this time, as shown in FIG. 10B, the shutter 48 is moved to an upper direction of the opening 42*a* by the protrusion 63*a*. In this manner, the opening 64*b* is communicated with the opening 42*a*, and the toner can be supplied to the developing cartridge 40 from the toner cartridge 60.

Further, at this time, the sponge 49 are in close contact with the sponge 65. An engaging portion 63*c* is integrally formed on an outer periphery surface of the inner cylinder 63 and is engaged with the rail 42*c*. Therefore, peripheries of the openings 64*b* and 42*a* are sealed and the toner never spills over to the outside. In addition, by the engagement of the engaging portion 63*c* and the rail 42*c*, the developing cartridge 40 is connected to the toner cartridge 60. Thereby, the developing cartridge 40 and the toner cartridge 60 can be mounted and removed in an integrated manner as described above (see FIG. 8). On contrary, the handle 62 is operated to rotate the inner cylinder 63, and the engaging portion 63*c* and the rail 42*c* are disengaged one from the other. Thereby, the toner cartridge 60 can be separated from the developing cartridge 40. Thus, only the toner cartridge 60 can be removed as described above (see FIG. 7).

In addition, a gear 901 is provided on an external side of one end of the inner cylinder 63. The gear 901 rotates with the agitator 61 in an integrated manner. A gear 902 is exposed on the supporting unit 42 at a position facing the gear 901. The gear 902 transmits a driving force to the gear 901. For this reason, by mounting the toner cartridge 60 in the supporting unit 42 and engaging the engaging portion 63*c* with the rail 42*c* as described above, the agitator 61 can be driven via the gears 902 and 901.

Further, a rotational shaft 903 of the gear 901 protrudes to the left and right as shown in FIG. 10C. A guide grooves 42*d* are formed on surfaces of left and right edges of the supporting unit 42. The guide grooves 42*d* guide the rotational shaft 903. When the toner cartridge 60 is mounted, the rotational shaft 903 can be guided by the guide grooves 42*d*. Therefore, the convex 64*a* can easily be engaged with the long groove 42*b*.

Figure 11A:
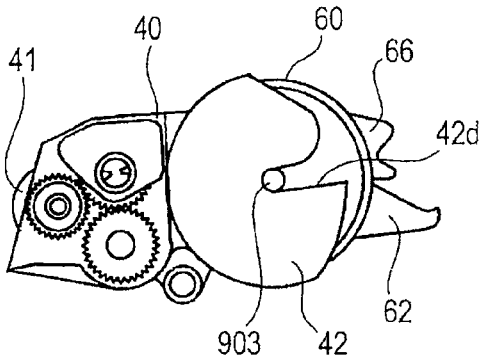
FIG. 11A is a right side view showing configurations of the developing cartridge and the toner cartridge.
Figure 11B:
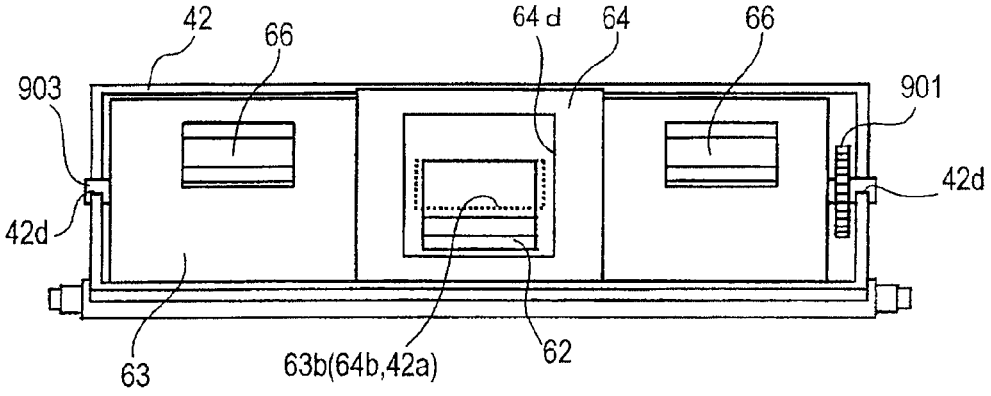
FIG. 11B is a front view showing configurations of the developing cartridge and the toner cartridge.
Figure 11C:
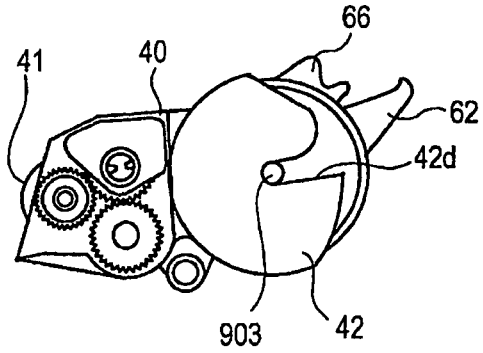
FIG. 11C is a right side view showing configurations of the developing cartridge and the toner cartridge.
Figure 11D:
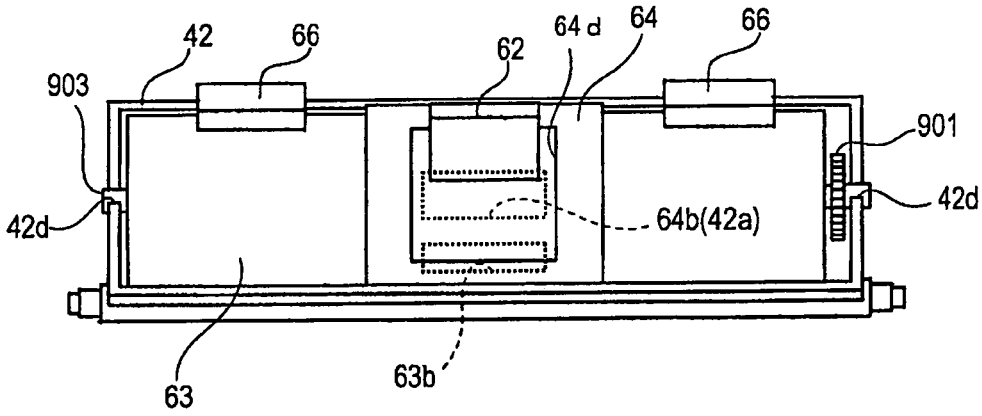
FIG. 11D is a front view showing configurations of the developing cartridge and the toner cartridge.

Next, FIG. 11B is a view of the developing cartridge 40 and the toner cartridge 60 viewed from a front surface side when the handle 62 is located at the connecting position as shown in FIG. 11A. FIG. 11D is a view of the developing cartridge 40 and the toner cartridge 60 viewed from a front surface side when the handle 62 is located at the separating position as shown in FIG. 11C.

As shown in FIGS. 11B and 11D, an opening 64*d* is formed on a front surface side of the outer cylinder 64. The opening 64*d* penetrates the outer cylinder 64 such that the handle 62 is rotatable. In addition, a pair of spring receiving part 66 and 66 are formed both the left and right of a front surface of the inner cylinder 63 at little upper positions than both sides of the handle 62. The pair of spring receiving units 66 and 66 have a depressed center part in a circumferential direction. As shown in FIG. 2, a pair of pressing members 71 and 71 is disposed on an inner surface of the lid portion 4. The pair of pressing members 71 and 71 is urged by springs (not shown) in a protruding direction of the pressing member 71. The spring receiving units 66 and 66 receive a pressing force from the pressing members 71 and 71 when the lid portion 4 is closed. Thus, each of the cartridges 20, 40, and 60 are securely fixed inside the laser printer 1 by the pressing force. In addition, an interfering member 72 protrudes between a position of the pressing members 71 and 71. If the handle 62 is not located in the connecting position, the lid portion 4 is configured so as to be unable to close due to interferences between the handle 62 and the interring member 72.

Figure 12A:
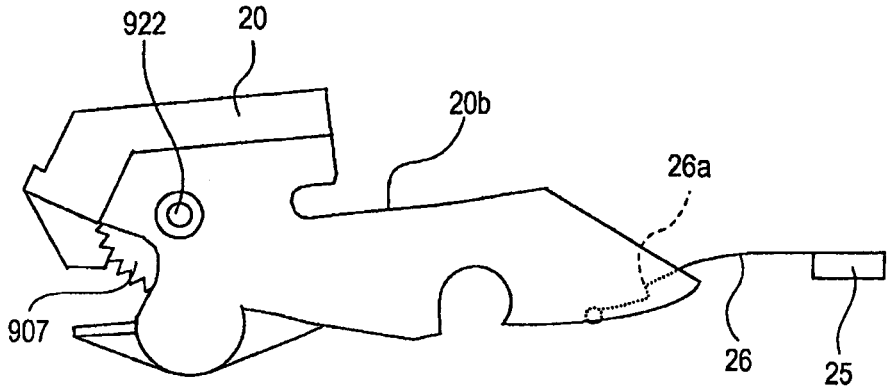
FIG. 12A is a right side view showing a configuration of a photosensitive member cartridge.
Figure 12B:
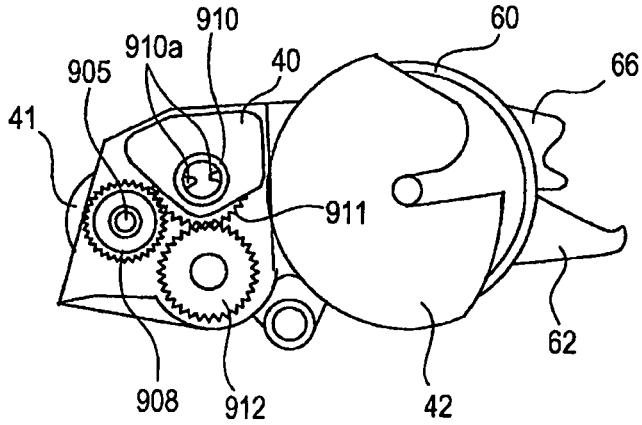
FIG. 12B is a right side view showing configurations of the developing cartridge and the photosensitive member cartridge.
Figure 12C:
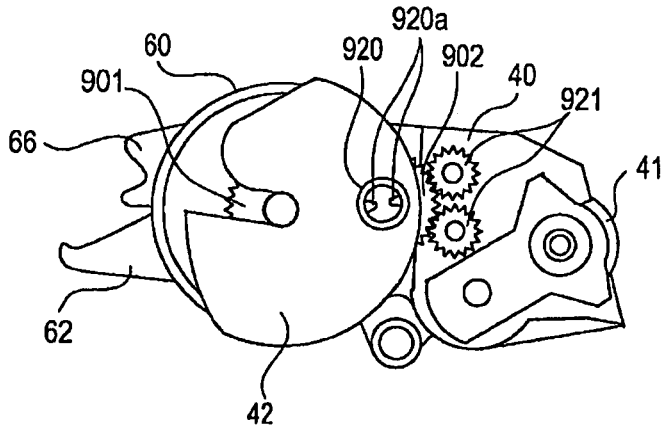
FIG. 12C is a left side view showing configurations of the developing cartridge and the photosensitive member cartridge.
Figure 12D:
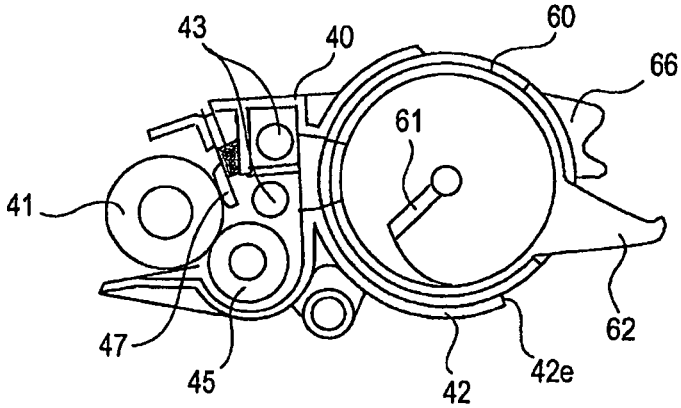
FIG. 12D is a vertical cross sectional diagram showing configurations of the developing cartridge and the photosensitive member cartridge.

Next, FIG. 12A is a right side view showing a configuration of the photosensitive member cartridge 20, FIG. 12B is a right side view showing configurations of the developing cartridge 40 and the toner cartridge 60, FIG. 12C is a left side view showing configurations of the developing cartridge 40 and the toner cartridge 60, and FIG. 12D is a vertical cross sectional diagram showing configurations of the developing cartridge 40 and the toner cartridge 60.

As shown in FIG. 12A, the handle 25 of the photosensitive member cartridge 20 is fixed to the photosensitive member cartridge 20 with a plate spring 26 therebetween. The plate spring 26 has a bending section 26*a* in the middle of the plate spring. The plate spring 26 is upwardly bent in a stepwise shape at the bending section 26*a*. When the developing cartridge 40 is mounted in the photosensitive member cartridge 20, the bending section 26*a* engages with a lower side 42*e* (see FIG. 12D) of the supporting unit 42 to connect the developing cartridge 40 to the photosensitive member cartridge 20. For this reason, when the handle 25 is pressed down (see FIG. 8) as described above, the bending section 26*a* and the lower side 42*e* are disengaged one from the other. Thereby, the developing cartridge 40 can be mounted in and removed from the photosensitive member cartridge 20.

In addition, a rotational shaft 905 of the developing roller 41 protrudes in both the left and right direction from the developing cartridge 40. Guide grooves 20*b* into which the rotational shaft 905 fits are formed on both the left and right surfaces of the photosensitive member cartridge 20. For this reason, the developing cartridge 40 is mounted in and removed from the photosensitive member cartridge 20 while both ends of the rotational shaft 905 are fitted into the guide groove 20*b*. Thereby, the mounting and removing of the developing cartridge 40 is facilitated.

A gear 907 is provided in the photosensitive member cartridge 20. The gear 907 rotates with the photosensitive drum 21 in an integrated manner. When the developing cartridge 40 and the photosensitive member cartridge 20 are mounted in the device body, the gear 907 engages with a gear 999 provided in the device body (see FIG. 13). In addition, a gear 908 is provided in the developing cartridge 40 and rotates with the developing roller 41 in an integrated manner. As shown in FIG. 12B, the gear 908 engages with a gear 911. A drive shaft 910 is provided on a right side surface of the developing cartridge 40. The gear 911 is rotates with the drive shaft 910 in an integrated manner. Further, the gear 911 also engages with a gear 912 which rotates with the supplying roller 45 in an integrated manner. For this reason, a driving force transmitted to the gear 999 is transmitted to the photosensitive drum 21, and a driving force transmitted to the drive shaft 910 is transmitted to the supplying roller 45 and the developing roller 41 as described later, respectively.

As shown in FIG. 12C, a drive shaft 920 is provided on a left side surface of the developing cartridge 40. The drive shaft 920 rotates with the gear 902 in an integrated manner. In addition, the gear 902 also engages with a pair of gears 921 and 921 which rotate with the pair of the augers 43 and 43 in an integrated manner. For this reason, when a driving force is transmitted to the drive shaft 920 of the developing cartridge 40 to which the toner cartridge 60 is connected, such driving force can further be transmitted to the agitator 61 and the pair of the augers 43 and 43.

Figure 13:
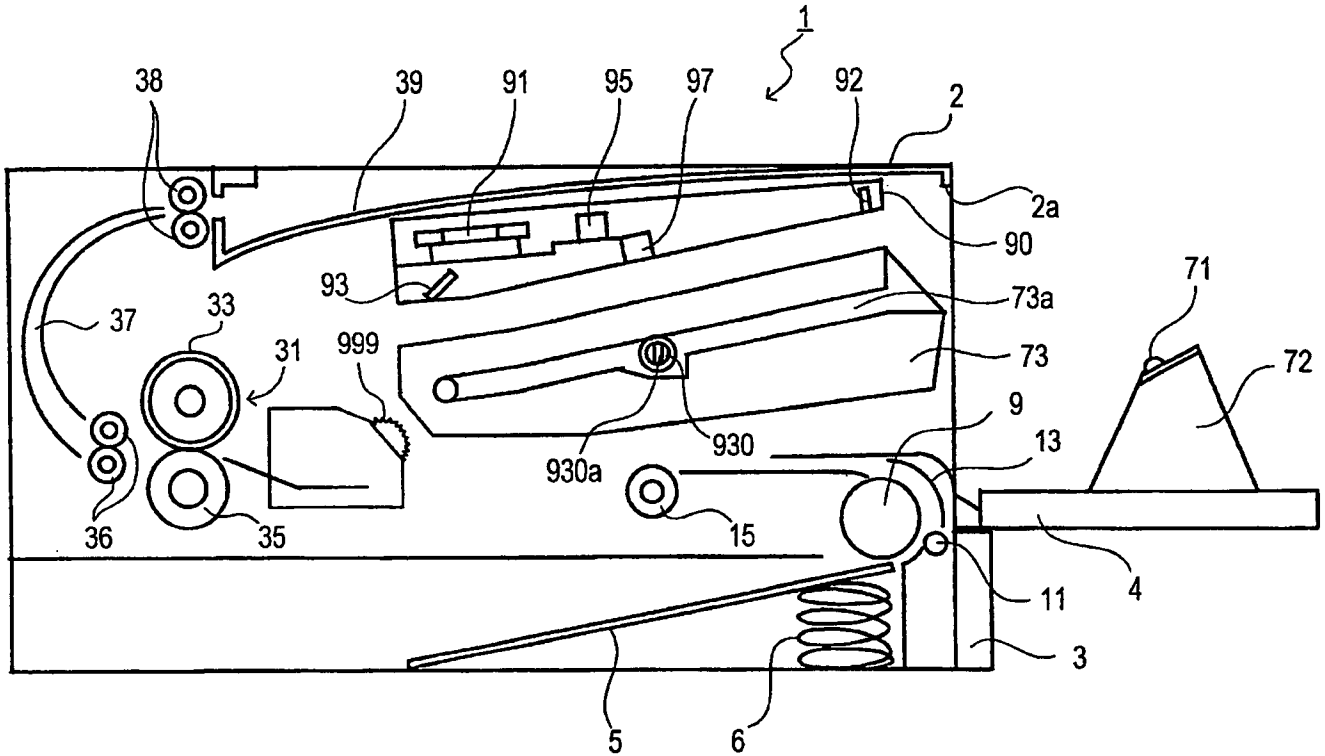
FIG. 13 is a vertical cross sectional diagram showing a state in which all the cartridges of the laser printer are removed.

FIG. 13 is a vertical cross sectional diagram showing a state in which all the cartridges 20, 40, and 60 of the laser printer 1 are removed. As shown in FIG. 13, guide members 73 and 73 for guiding the photosensitive member cartridge 20 and the developing cartridge 40 are provided on left and right inner wall surfaces of the cover 2 (only left side one is illustrated in FIG. 13). The guide members 73 and 73 are provided with guide grooves 73*a* and 73*a* having a substantially linear shape. The guide grooves 73*a* and 73*a* guide both ends of a rotational shaft 922 of the photosensitive drum 21 (see FIG. 12A) and the drive shaft 910 or 920 described above. The drive shafts 930 and 930 are disposed at positions on the guide grooves 73*a* and 73*a* where the guide grooves 73*a* and 73*a* face the drive shafts 910 and 920 when the developing cartridge 40 is mounted. The drive shafts 930 and 930 are rotatably provided. The drive shafts 930 and 930 transmit a driving force from a main motor (not shown) provided in the device body of the laser printer 1.

As shown in FIGS. 12B and 12C, both the drive shafts 910 and 920 have a hollow cylinder shape. A pair of protrusions 910*a* and 910*a* is provided at position facing each other at 180° on an inner surface wall the drive shaft 910. A pair of protrusions 920*a* and 920*a* is provided at position facing each other at 180° on the inner surface wall of the drive shaft 920. The drive shaft 930 is configured so as to be able to fit in a hollow part of the drive shafts 910 and 920. Further, grooves 930*a* are formed on the drive shafts 930. The grooves are engaged with the protrusion 910*a* and 920*a*. For this reason, by protruding the drive shafts 930 and 930 and engaging the drive shafts 930 and 930 with the drive shafts 910 and 920 after all the cartridges 20, 40, and 60 are mounted, each unit can drive as described above.

In the laser printer 1 according to the present embodiment as described above, the following can be carried out depending on what is required: removing and exchanging the photosensitive member cartridge 20, the developing cartridge 40, and the toner cartridge 60 in an integrated manner (see FIG. 5); removing and exchanging only the developing cartridge 40 and the toner cartridge 60 in an integrated manner (see FIG. 8); and removing and exchanging only the toner cartridge 60 (see FIG. 7). For this reason, exchanging work of each of the cartridges 20, 40, and 60 can be efficiently carried out. Further, since only the cartridges which need to be exchanged can be exchanged, the laser printer 1 according to the present embodiment provides excellent cost effectiveness.

When printing is carried out in the proportion of 5% with respect to an entire area of A4-size paper, life of the photosensitive member cartridge 20 is for 50000 sheets of paper, while life of the developing cartridge 40 is for 20000 sheets of paper and life of the toner cartridge 60 is for 3000 sheets of paper. The lives of each of the cartridges are based on following matters. That is, in the photosensitive member cartridge 20, the toner adhered to the developing roller 41 grinds a photosensitive layer of the photosensitive drum 21 like an abrading agent. Further, charging characteristics is degraded with age. For the above reasons, the photosensitive drum 21 can no longer stand the use after printing for around 50000 sheets of the A4-size paper. As for the developing cartridge 40, the developing roller 41 can no longer exert the performance after printing for around 20000 sheets of the A4-size paper due to friction with the supplying roller 45 and the developing blade 47. The toner cartridge 60 contains the toner for an amount enough for printing around 3000 sheets of A4-size paper.

As described above, the life of each of the cartridges 20, 40, and 60 is different from the other cartridges. For this reason, the cartridges are arranged, from the mounting/removing opening 2*a* side, in the order of shorter life, i.e. in the order of the toner cartridge 60, the developing cartridge 40, and the photosensitive member cartridge 20, which is the order of higher frequency of exchange. In this manner, as described above, only a part of the cartridges in the front can be exchanged, while the other cartridges deeper inside than the part of the cartridges is mounted in the device body. Therefore, workability of the exchange is further improved. When resolving paper jam, it is convenient to remove the photosensitive member cartridge 20, the developing cartridge 40, and the toner cartridge 60 in an integrated manner.

Further, each of the cartridges 20, 40, and 60 can be mounted and removed through the common mounting/removing opening 2*a* after passing through a common mounting and removing path. Therefore, the device does not become larger, and the mounting/removing opening 2*a* can be made comparatively small. Accordingly, a simplified configuration of the device is achieved. Therefore, in the laser printer 1 according to the present embodiment, a degree of freedom as to where to install the device is improved, and a manufacturing cost can be reduced. Further, the mounting/removing opening 2*a* is provided on a front surface side, and the front surface side is a side where the paper feeding cassette 3 is mounted in or removed from the device. Therefore, the mounting and removing of each of the cartridges 20, 40, and 60 is further facilitated.

The mounting and removing path of each of the cartridges 20, 40, and 60 may be curved. However, in the laser printer 1, each of the cartridges 20, 40, and 60 is mounted or removed along the guide groove 73*a* having a substantial linear shape. Therefore, the mounting and removing of each of the cartridges 20, 40, and 60 is further facilitated.

In addition, since the interfering member 72 is provided in the laser printer 1, the lid portion 4 cannot be closed if the handle 62 of the toner cartridge 60 is not located at the connecting position. In this manner, wrong operation such as instructing driving while the developing cartridge 40 and the toner cartridge 60 are separated can be prevented. The handle 62 may be interfere with, instead of the interfering member 72, a path of some member which works in association with the lid portion 4 such that the some member prevent the lid portion 4 from being closed. In this case as well, a similar effect can be obtained.

Figure 14:
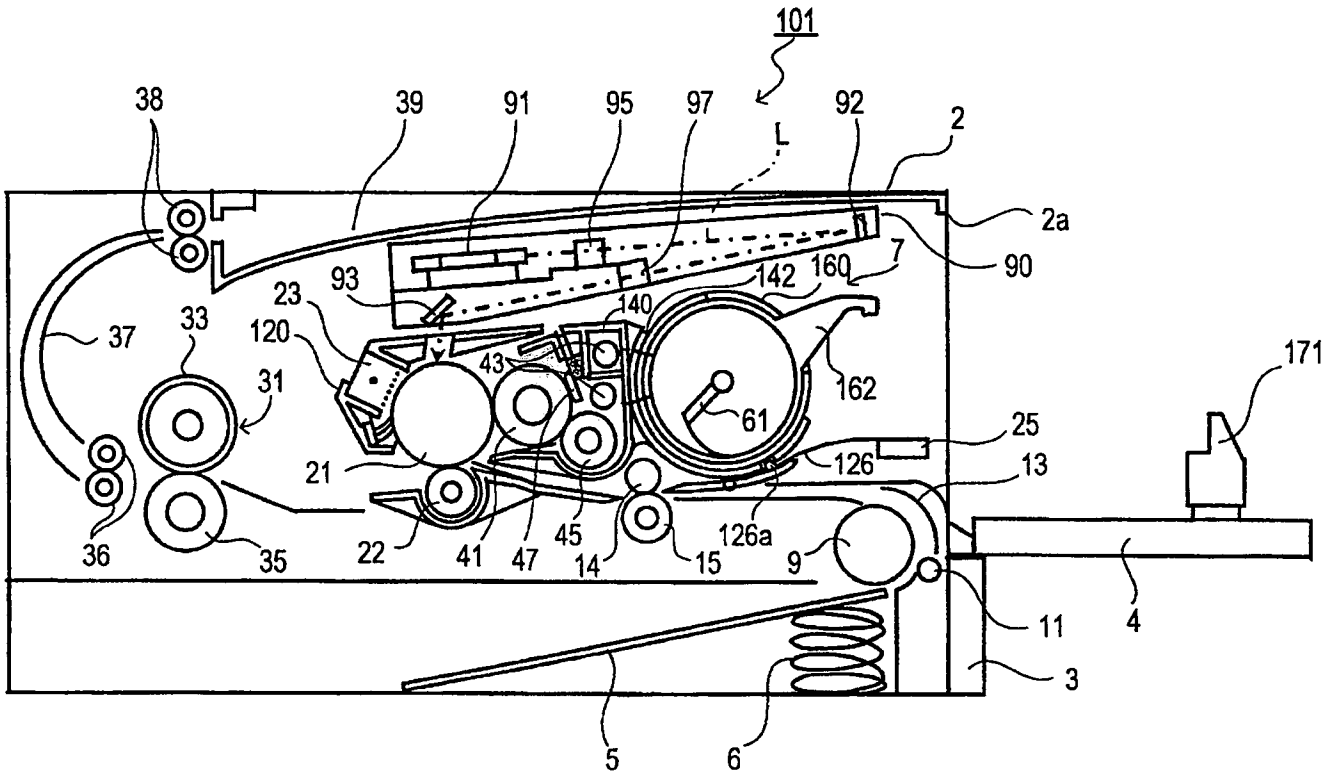
FIG. 14 is a vertical cross sectional diagram showing a configuration of a laser printer according to a second embodiment.

Next, FIG. 14 is a vertical cross sectional diagram showing a configuration of a laser printer 101 according to a second embodiment of the present invention. In each of the embodiments, a part similar to the laser printer 1 according to the first embodiment is indicated by the same reference numeral as used in FIGS. 1 to 13, and detailed description thereof is omitted.

The laser printer 101 according to the present embodiment is different from the laser printer 1 in a point that a supporting unit 142 provided in a developing cartridge 140. The supporting unit 142 has an opening toward a substantial upper direction and supports the toner cartridge 160. In accordance therewith, a hole 142*e* (see FIG. 16) is provided in the supporting unit 142 in place of the lower side 42*e*. A plate spring 126 which connects the handle 25 to a photosensitive member cartridge 120 is provided with a protrusion 126*a* fitting in the hole 142*e* in place of the bending section 26*a*.

In addition, as shown in FIG. 14, a handle 162 of the toner cartridge 160 is provided on an upper portion of the toner cartridge 160 even when the handle 162 is located at a connecting position. The lid portion 4 is provided with a pressing member 171 which presses the handle 162. Further, the laser printer 101 is not provided with the spring receiving unit 66 or the interfering member 72.

Figure 15:
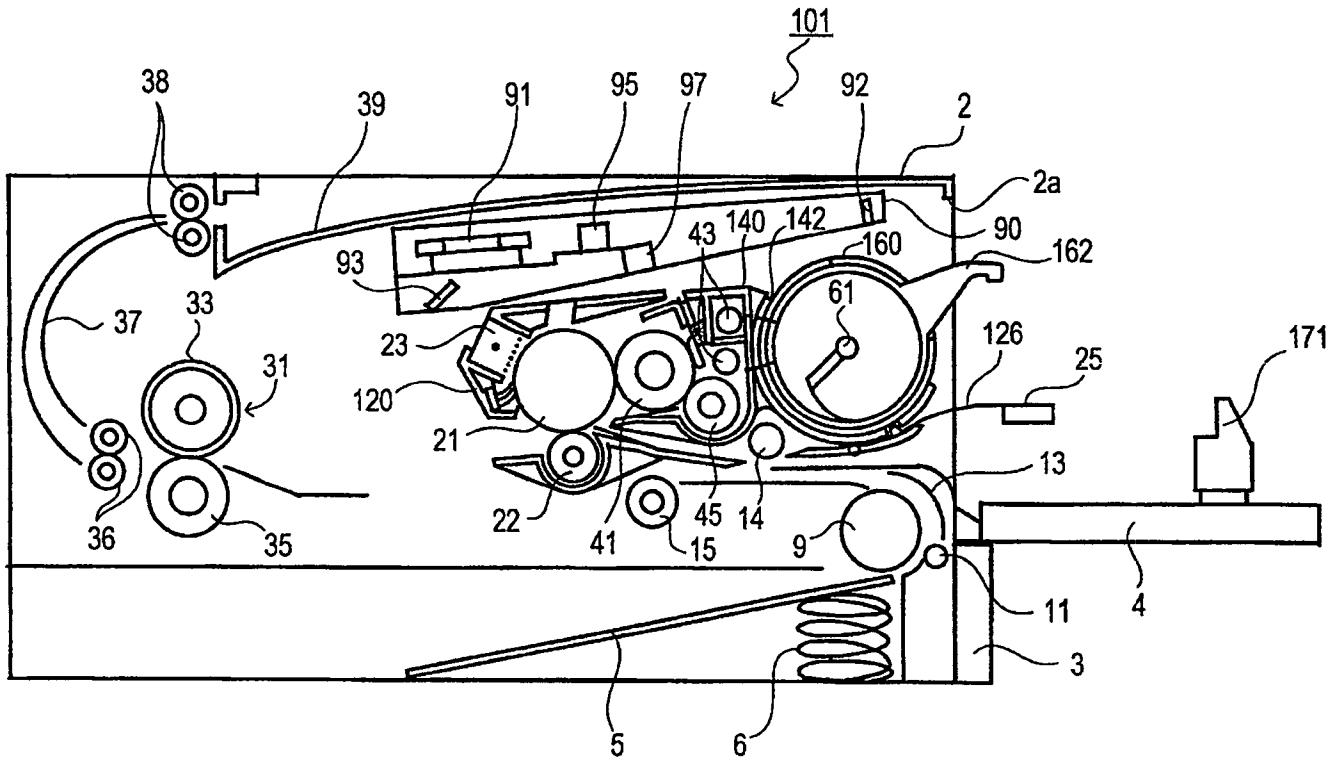
FIG. 15 is a vertical cross sectional diagram showing an operation of removing each of the cartridges of the laser printer in an integrated manner.

In the laser printer 101 as well, as shown in FIG. 15, after the lid portion 4 is opened and the handle 25 of the photosensitive member cartridge 120 is pulled in a front direction, the photosensitive member cartridge 120, the developing cartridge 140, and the toner cartridge 160 can be removed in an integrated manner from the mounting/removing opening 2*a* to outside the device body of the laser printer 101.

In addition, when the handle 25 of the photosensitive member cartridge 120 is pressed down, the developing cartridge 140 is separated from the photosensitive member cartridge 120. Subsequently, as shown in FIG. 16, when the handle 162 of the toner cartridge 160 is pulled in a front direction as-is, the toner cartridge 160 and the developing cartridge 140 can be taken out from the mounting/removing opening 2*a* to outside the device body.

However, in the laser printer 101, the supporting unit 140 has the opening in a substantial upper direction as described above. Therefore, the toner cartridge 160 cannot be mounted or removed while the developing cartridge 140 is left inside the device body. For this reason, the mounting and removing of the toner cartridge 160 is carried out as described below.

Figure 16:
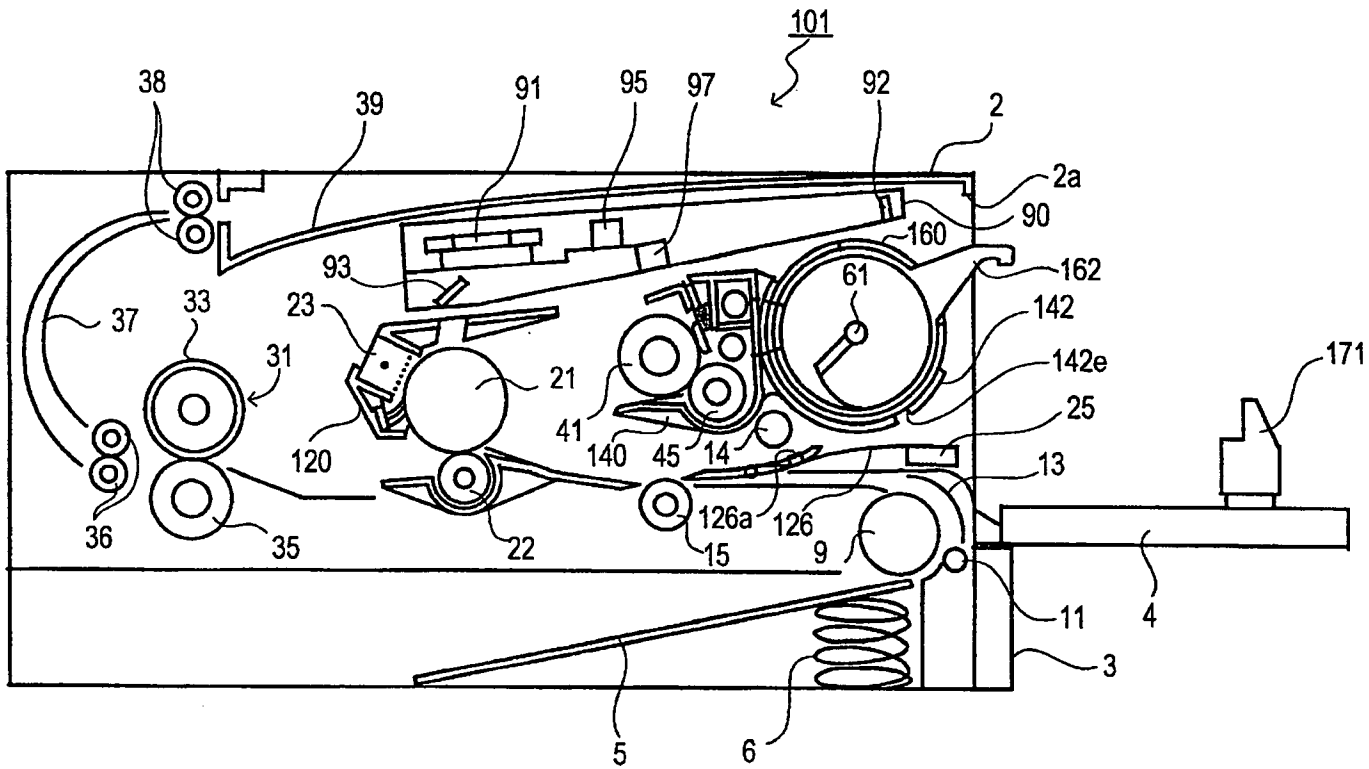
FIG. 16 is a vertical cross sectional diagram showing an operation of removing the developing cartridge and a toner cartridge of the laser printer in an integrated manner.
Figure 17A:
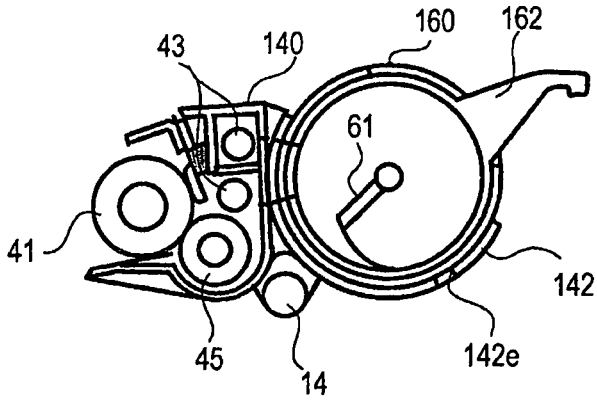
FIG. 17A is a vertical cross sectional diagram showing operation of separating the toner cartridge and the developing cartridge of the laser printer.
Figure 17B:
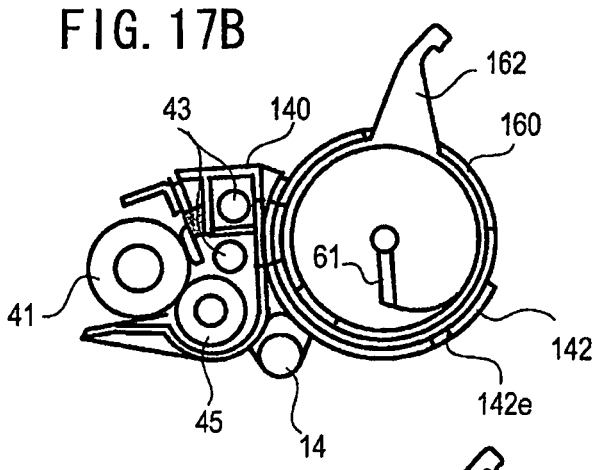
FIG. 17B is a vertical cross sectional diagram showing operation of rotating a handle directly to the above for separating the toner cartridge and the developing cartridge of the laser printer.
Figure 17C:
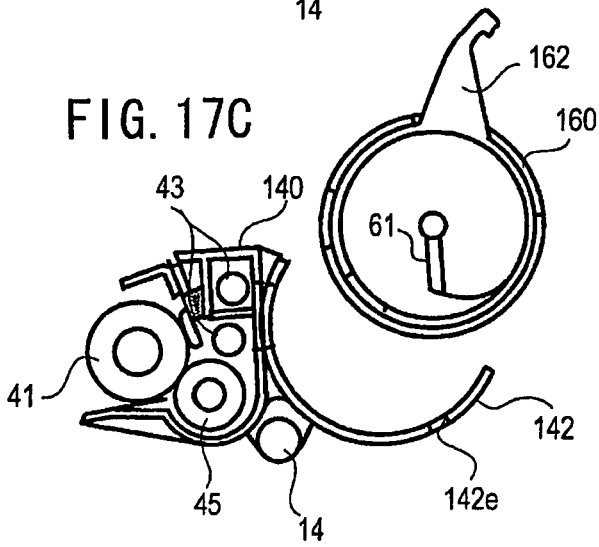
FIG. 17C is a vertical cross sectional diagram showing a state in which the toner cartridge and the developing cartridge of the laser printer are separated.

FIG. 17A shows the developing cartridge 140 and the toner cartridge 160 taken out as shown in FIG. 16. A connection and separation between the developing cartridge 140 and the toner cartridge 160 are switched over by a mechanism similar to the laser printer 1. The developing cartridge 140 and the toner cartridge 160 are separated when the handle 162 is rotated to a directly above direction as shown in FIG. 17B. In this state, when the toner cartridge 160 is pulled upwardly by holding the handle 162, the toner cartridge 160 is separated from the developing cartridge 140 as shown in FIG. 17C. Thereby, exchange of the toner cartridge 160 can be carried out.

In addition, as shown in FIG. 17B, when the developing cartridge 140 and the toner cartridge 160 are attempted to mount in the device body while the developing cartridge 140 and the toner cartridge 160 are separated, the handle 162 interferes with the scanner unit 90. Therefore, in the present embodiment as well, the device is prevented from driving while the developing cartridge 140 and the toner cartridge 160 are separated.

Figure 18:
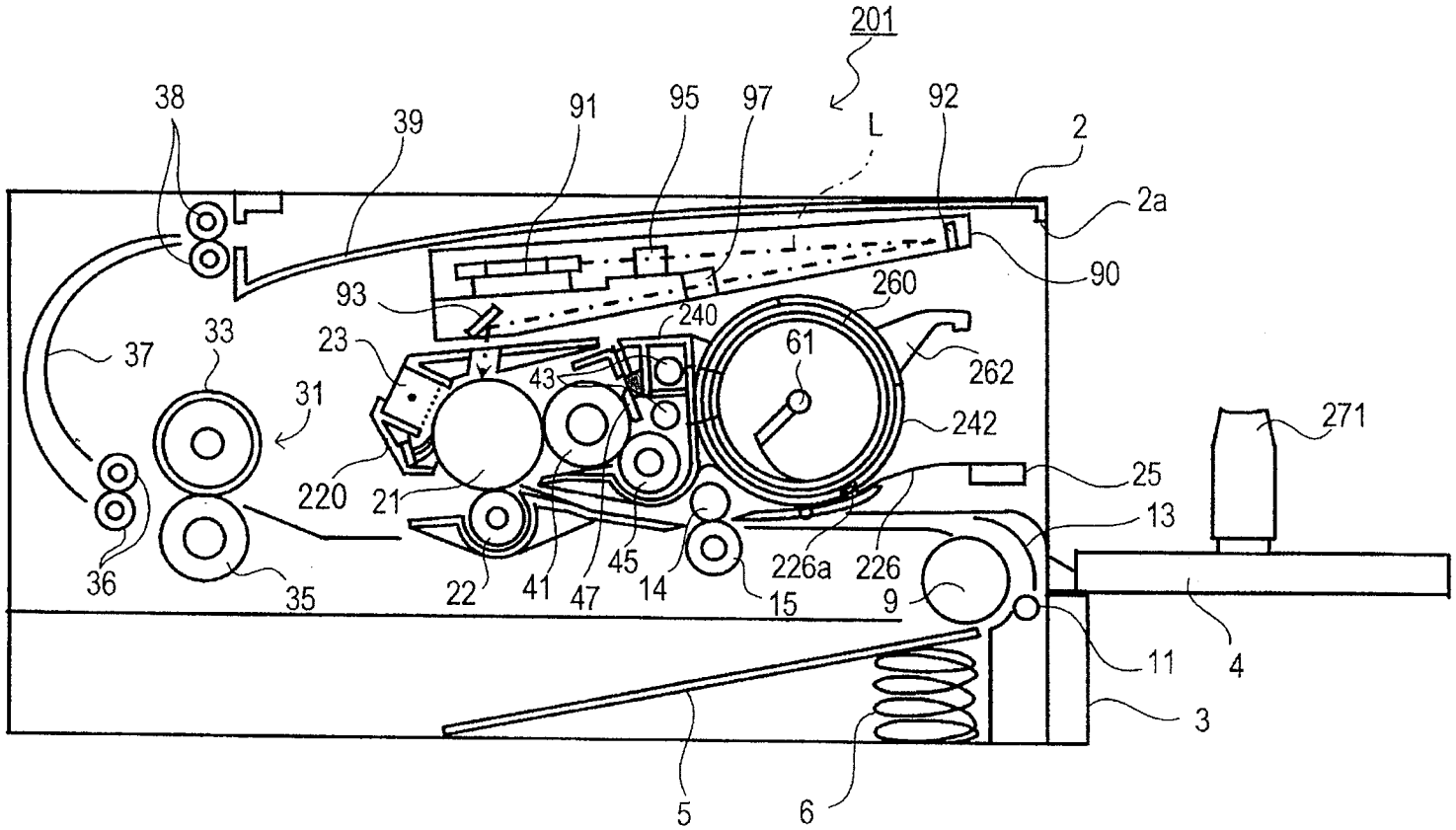
FIG. 18 is a vertical cross sectional diagram showing a configuration of a laser printer according to a third embodiment.

FIG. 18 is a vertical cross sectional diagram showing a configuration of a laser printer 201 according to a third embodiment of the present invention. The laser printer 201 is different from the laser printer 1 in a point that a supporting unit 242 is provided in the developing cartridge 240. The supporting unit 242 has a cylindrical shape surrounding an outer periphery of the toner cartridge 260 to support the toner cartridge 260. In accordance therewith, a hole 242*e* (see FIG. 19) is formed on the supporting unit 242 similar to the laser printer 101. A plate spring 226 connecting the handle 25 to a photosensitive member cartridge 220 is provided with a protrusion 226*a* which fits into the hole 242*e*.

In addition, a handle 262 of the toner cartridge 260 is provided on an upper portion of the toner cartridge even when the handle 262 is provided at the connecting position shown in FIG. 18. Further, the handle 262 protrudes from a left end (right end as viewed from a front side) of the supporting unit 242 as shown in FIGS. 20A to 20F described later. In addition, the lid portion 4 is provided with a pressing member 271 which directly presses a surface in the front portion of the supporting unit 242. Similar to the laser printer 101, the spring receiving unit 66 or the interfering member 72 are not provided.

In the laser printer 201 as well, after the lid portion 4 is opened and the handle 25 of the photosensitive member cartridge 220 is pulled in a front direction, the photosensitive member cartridge 220, the developing cartridge 240, and the toner cartridge 260 can be removed in an integrated manner from the mounting/removing opening 2*a* to outside the device body of the laser printer 201.

Figure 19:
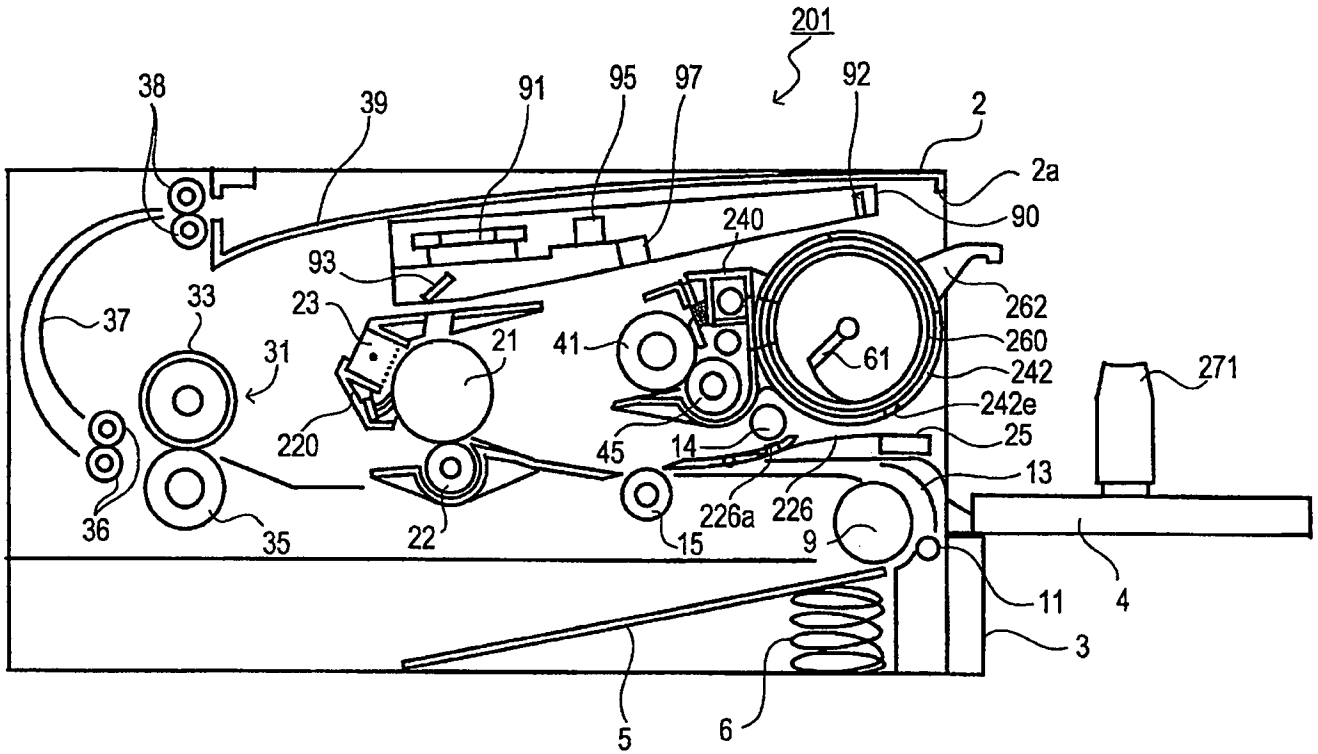
FIG. 19 is a vertical cross sectional diagram showing operation of removing a developing cartridge and a toner cartridge of the laser printer in an integrated manner.

In addition, when the handle 25 of the photosensitive member cartridge 220 is pressed down, the developing cartridge 240 is separated from the photosensitive member cartridge 220. Further, when the handle 262 of the toner cartridge 260 is pulled in a front direction as-is, the toner cartridge 260 and the developing cartridge 240 can be removed from the mounting/removing opening 2*a* to outside the device body as shown in FIG. 19.

Figure 20A:
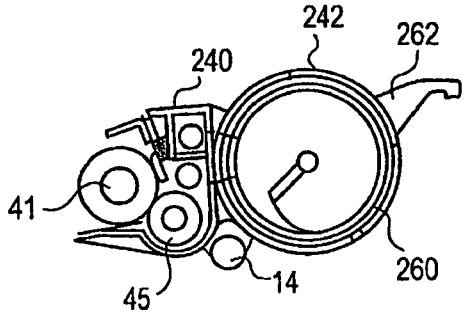
FIG. 20A is a vertical cross sectional diagram showing an operation of separating the toner cartridge and the developing cartridge of the laser printer.
Figure 20B:
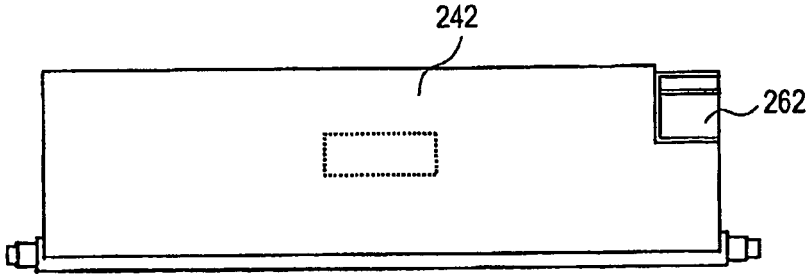
FIG. 20B is a front view showing operation of separating the toner cartridge and the developing cartridge of the laser printer.
Figure 20C:
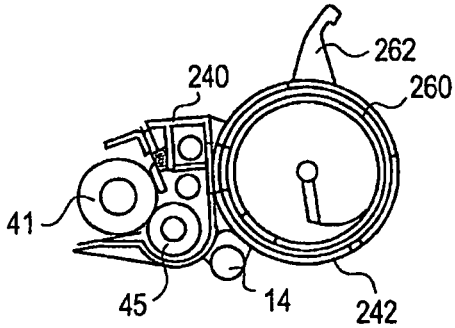
FIG. 20C is a vertical cross sectional diagram showing a state in which the handle is rotated directly to the above in order to separate the toner cartridge and the developing cartridge of the laser printer.
Figure 20D:
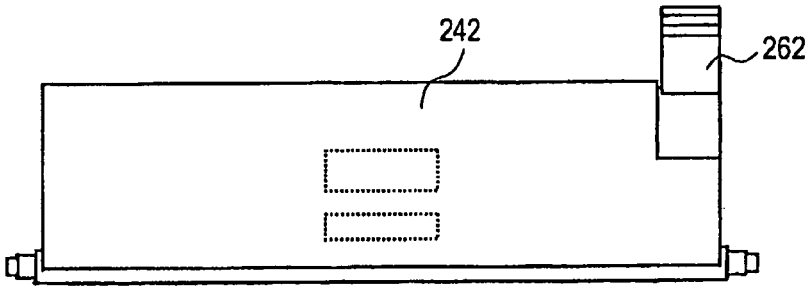
FIG. 20D is a front view showing a state in which the handle is rotated directly above in order to separate the toner cartridge and the developing cartridge of the laser printer.
Figure 20E:
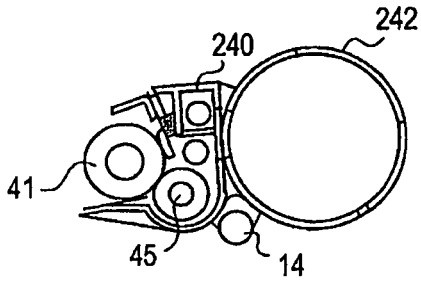
FIG. 20E is a vertical cross sectional diagram showing a state in which the toner cartridge of the laser printer is pulled out from the developing cartridge.
Figure 20F:
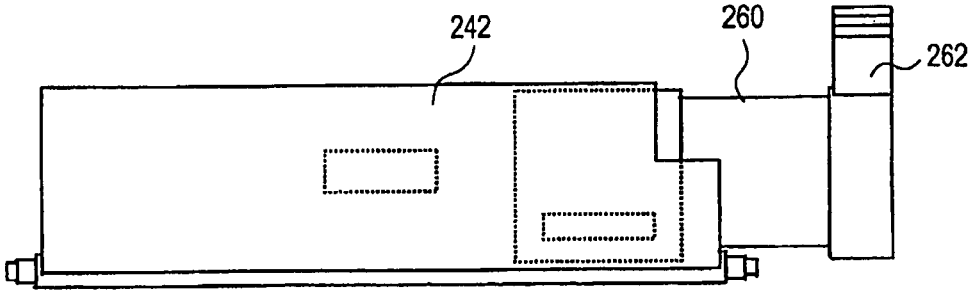
FIG. 20F is a front view showing a state in which the toner cartridge of the laser printer is pulled out from the developing cartridge.

FIGS. 20A and 20B show a vertical cross sectional diagram and a front view of the developing cartridge 240 and the toner cartridge 260 is removed as described above. A connection and separation between the developing cartridge 240 and the toner cartridge 260 are switched over by a mechanism similar to the laser printer 1. The developing cartridge 240 is disengaged from the toner cartridge 260 when the handle 262 is rotated to a directly above direction as shown in FIGS. 20C and 20D. In this state, when the toner cartridge 260 is pulled to a side direction by holding the handle 262, exchange of the toner cartridge 260 can be carried out as shown in FIGS. 20E and 20F.

So far, embodiments of the present invention have been described. In the above embodiments, the handles 25, 62, 162, and 262 correspond to an operation unit, and the guide grooves 20*b* and 42*d* correspond to a guide. The image forming device according to the present invention are not limited to the embodiments described above. Various modifications and changes can be made without departing from the scope of the inventions. For example, the photosensitive member cartridge, the developing cartridge, and the toner cartridge may be removed outside the device body in an integrated manner and then separated into individual cartridges. In addition, in the laser printer 1, the rotational shafts 903 and 905 are guided by the guide grooves 42*b* and 20*b*. However, the toner cartridge 60 or the developing cartridge 40 may include protruding shaft members parallel to the rotational shafts 903 and 905, and thereby the shaft members may be guided in a similar manner as the rotational shafts 903 and 905.

The invention claimed is:

1. An image forming device comprising:

an image bearing member cartridge configured to accommodate an image bearing member therein and including a first operation portion;

a toner cartridge configured to accommodate toner therein and including a second operation portion; and a developer cartridge configured to accommodate a developer unit therein, wherein the developer unit is configured to develop an electrostatic latent image formed on the image bearing member by the toner accommodated in the toner cartridge, wherein the image bearing member cartridge, the toner cartridge, and the developer cartridge are detachably mountable to the image forming device, wherein the image bearing member cartridge, the toner cartridge, and the developer cartridge are mountable to and removable from a body of the image forming device through a common loading port in communication with a common path, wherein the first operation portion is movable between a first state in which the developer cartridge is engaged with the image bearing member cartridge and a second state in which the developer cartridge is disengaged from the image bearing member cartridge, wherein the second operation portion is movable between a third state in which the toner cartridge is engaged with the developer cartridge and a fourth state in which the toner cartridge is disengaged from the developer cartridge, wherein, when the second operation portion is in the fourth state, the toner cartridge is removable from the image forming device independently of the developer cartridge, wherein, when the second operation portion is in the third state and the first operation portion is in the second state, the developer cartridge is removable together with the toner cartridge without removing the image bearing cartridge, and wherein, when the second operation portion is in the third state and the first operation portion is in the first state, the developer cartridge, the toner cartridge and the image bearing member cartridge are removable together.

2. The image forming device as claimed in claim 1, wherein the image bearing member cartridge, the toner cartridge, and the developer cartridge are mountable to and removable from the body of the image forming device while holding the cartridges in an integrally combined state.

3. The image forming device as claimed in claim 1, wherein the second operation portion includes a handle, and a cartridge to be left inside the body of the image forming device is selectable by moving the handle between the third state and the fourth state.

4. The image forming device as claimed in claim 3, wherein, when the handle is located in the fourth state, the handle interferes with a path of a lid portion configured to cover the loading port of the body of the image forming device, such that the lid portion is not capable of being closed or the handle interferes with a path of a member that moves with the lid portion such that the lid portion is not capable of being closed.

5. The image forming device as claimed in claim 1, wherein the second operation portion is operable when the toner cartridge is mounted to the body of the image forming device.

6. The image forming device as claimed in claim 1, wherein the toner cartridge, the developer cartridge, and the image bearing member cartridge are located in this order from the loading port to an inside the image forming device, when the toner cartridge, the developer cartridge, and the image bearing member cartridge are mounted in the image forming device.

7. The image forming device as claimed in claim 1, wherein the image bearing member cartridge, the toner cartridge, and the developer cartridge are located in an order of lifetime from the loading port to an inside the image forming device.

8. The image forming device as claimed in claim 1, wherein a path on which the image bearing member cartridge is independently mounted to or removed from the body of the image forming device, a path on which the toner cartridge is independently mounted to or removed from the body of the image forming device, and a path on which the developer cartridge is independently mounted to or removed from the body of the image forming device are along a same straight line.

9. The image forming device as claimed in claim 1, wherein the loading port is disposed on a front side of the body of the image forming device.

10. The image forming device as claimed in claim 1, wherein the body of the image forming device is configured to detachably mount a feeding cassette, wherein the feeding cassette is configured to accommodate recording sheets to which the toner developing the electrostatic latent image formed on the image bearing member is adhered, wherein the loading port is disposed on a side from which the feeding cassette is mounted to and removed from the body of the image forming device.

11. The image forming device as claimed in claim 1, wherein either the image bearing member cartridge, or the developer cartridge that is disposed in a downstream side with respect to a mounting direction is formed with a guide that guides another cartridge that is disposed at an upstream side.

12. The image forming device as claimed in claim 1, wherein at least one of the image bearing member cartridge, and the developer cartridge includes a drum or a roller, and the image bearing member cartridge, the toner cartridge, and the developer cartridge are mountable to or removable from the image forming device in a direction orthogonal to a rotational axis of the drum or the roller.

13. A toner cartridge connectable with a developer cartridge and an image bearing cartridge, the toner cartridge comprising:

a first operation portion movable between a first state in which the toner cartridge is engaged with the developer cartridge and a second state in which the toner cartridge is disengaged from the developer cartridge, wherein a second operation portion of the image bearing member cartridge is movable between a third state in which the developer cartridge is engaged with the image bearing member cartridge and a fourth state in which the developer cartridge is disengaged from the image bearing member cartridge, wherein, when the first operation portion is in the second state, the toner cartridge is removable from an image forming device independently of the developer cartridge, wherein, when the first operation portion is in the first state and the second operation portion is in the fourth state, the developer cartridge is removable from the image forming device together with the toner cartridge without removing the image bearing cartridge, and wherein, when the first operation portion is in the first state and the second operation portion is in the third state, the developer cartridge, the toner cartridge and the image bearing member cartridge are removable together.

14. The toner cartridge as claimed in claim 13, wherein the first operation portion includes a handle for mounting or removing the toner cartridge from the image forming device, wherein a connection/separation between the developer cartridge and the toner cartridge is switched by moving a position of the handle.

15. The toner cartridge as claimed in claim 14, wherein when the handle is located in the second state, the handle interferes with a path of a lid portion configured to cover a loading port formed in a body of the image forming device and through which the toner cartridge is mountable and removable, such that the lid portion is not capable of being closed or the handle interferes with a path of a member that moves with the lid portion such that the lid portion is not capable of being closed.

16. An image forming device including:

an image bearing member cartridge including an image bearing member;

a toner cartridge accommodating toner, the toner cartridge being detachably attachable on a body of the image forming device; and a developer cartridge including a developer unit configured to develop an electrostatic latent image on the image bearing member by the toner accommodated in the toner cartridge, wherein the toner cartridge comprises an agitator configured to agitate the toner, the agitator including a rotational shaft, wherein the rotational shaft of the agitator is guided by a first guide formed in the developer cartridge, wherein the image bearing member cartridge includes a second guide configured to guide the developer cartridge, wherein the second guide is formed parallel to a direction in which the developer cartridge is mounted to or removed from the image bearing member cartridge, wherein the toner cartridge further comprises an operation portion movable between a first state in which the toner cartridge is engaged with the developer cartridge and a second state in which the toner cartridge is disengaged from the developer cartridge, and wherein the first guide is parallel to the second guide.

* * * * *

UNITED STATES PATENT AND TRADEMARK OFFICE

CERTIFICATE OF CORRECTION

PATENT NO. : 8,478,163 B2
APPLICATION NO. : 11/666604
DATED : July 2, 2013
INVENTOR(S) : Sato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1740 days.

Signed and Sealed this
Eighth Day of September, 2015

Michelle K. Lee

Michelle K. Lee
*Director of the United States Patent and Trademark Office*